US011320776B2

(12) United States Patent
Hatakeyama et al.

(10) Patent No.: US 11,320,776 B2
(45) Date of Patent: May 3, 2022

(54) IMAGE FORMING APPARATUS HAVING A GUIDE MEMBER FORMING A RECONVEYANCE PATH

(71) Applicant: BROTHER KOGYO KABUSHIKI KAISHA, Nagoya (JP)

(72) Inventors: Shinichi Hatakeyama, Aichi (JP); Shota Shinoya, Nisshin (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/103,889

(22) Filed: Nov. 24, 2020

(65) Prior Publication Data

US 2021/0165356 A1 Jun. 3, 2021

(30) Foreign Application Priority Data

Nov. 28, 2019 (JP) ..... JP2019-215622
Nov. 28, 2019 (JP) ..... JP2019-215623

(51) Int. Cl.
*G03G 21/16* (2006.01)
*G03G 15/23* (2006.01)
*G03G 15/00* (2006.01)

(52) U.S. Cl.
CPC ..... *G03G 15/6552* (2013.01); *G03G 15/234* (2013.01); *G03G 15/6573* (2013.01); *G03G 15/6579* (2013.01); *G03G 21/1633* (2013.01); *G03G 2215/00421* (2013.01);
(Continued)

(58) Field of Classification Search
CPC ..... G03G 15/6552; G03G 15/6573; G03G 21/1633; G03G 15/6579; G03G 2215/00675; G03G 15/234; G03G 2215/0043; G03G 2215/00438; G03G 2215/00421
See application file for complete search history.

(56) References Cited

U.S. PATENT DOCUMENTS 6,983,122 B2 * 1/2006 Hayamizu ..... B41J 3/60 271/184
2007/0069454 A1 * 3/2007 Ino ..... B65H 43/06 271/220
2012/0038101 A1 2/2012 Osaki
(Continued)

FOREIGN PATENT DOCUMENTS

JP 2012-035994 A 2/2012
JP 2016-190696 A 11/2016

*Primary Examiner* — Walter L Lindsay, Jr.
*Assistant Examiner* — Laura Roth
(74) *Attorney, Agent, or Firm* — Baker Botts L.L.P.

(57) ABSTRACT

An image forming apparatus includes an image forming engine, a re-conveyance path configured to guide a sheet, on which an image is formed by the image forming engine, to be switched back and re-conveyed toward the image forming engine. The apparatus also includes a discharge tray, and a discharge path configured to guide the sheet in a sheet discharge direction toward the discharge tray. A stack lever is configured to contact a top surface of the sheet on the discharge tray and press the sheet toward the discharge tray. A guide member is configured to form a part of the re-conveyance path, extend up to a position downstream of the stack lever in the sheet discharge direction above the stack lever, and guide the sheet being conveyed along the re-conveyance path, between the guide member and the stack lever.

20 Claims, 15 Drawing Sheets

(52) U.S. Cl.
CPC ..... *G03G 2215/00438* (2013.01); *G03G 2215/00675* (2013.01)

(56) References Cited

U.S. PATENT DOCUMENTS

| | | | | |
|---|---|---|---|---|
| 2016/0289036 | A1 | 10/2016 | Kosaka | |
| 2019/0033769 | A1* | 1/2019 | Shiina | B65H 29/125 |
| 2020/0002116 | A1* | 1/2020 | Mizuguchi | B65H 29/125 |
| 2020/0073311 | A1* | 3/2020 | Saito | G06F 3/121 |
| 2020/0277155 | A1* | 9/2020 | Sano | G03G 15/234 |

* cited by examiner

IMAGE FORMING APPARATUS HAVING A GUIDE MEMBER FORMING A RECONVEYANCE PATH

CROSS-REFERENCE TO RELATED APPLICATION

This application claims priority under 35 U.S.C. § 119 from Japanese Patent Applications No. 2019-215622 and No. 2019-215623 each filed on Nov. 28, 2019. The entire subject matter of the applications is incorporated herein by reference.

BACKGROUND

Technical Field

Aspects of the present disclosure are related to an image forming apparatus.

Related Art

Heretofore, an image forming apparatus (hereinafter referred to as a "first image forming apparatus") has been known that includes a discharge tray to support sheets discharged thereon via a discharge path, a re-conveyance path on which a sheet to be duplex-printed is switched back, and stack levers configured to contact a top surface of the sheets discharged on the discharge tray and press the sheets toward the discharge tray.

In the first image forming apparatus, a sheet being conveyed along the re-conveyance path may come into contact with the top surface of the sheets stacked on the discharge tray and push out some of the stacked sheets, thereby disarranging the alignment of the stacked sheets. In particular, as the number of the sheets stacked on the discharge tray increases, a contact point, at which the sheet being conveyed along the re-conveyance path comes into contact with the sheets stacked on the discharge tray, becomes closer to the re-conveyance path. Thereby, since a distance over which the sheet being conveyed along the re-conveyance path pushes out some of the stacked sheets becomes longer, the alignment of the stacked sheets might be more disarranged.

Accordingly, the first image forming apparatus is configured to guide the sheet being conveyed along the re-conveyance path, by upper surfaces of the stack levers positioned below the sheet. Thereby, the sheet, which is being conveyed along the re-conveyance path, is kept from contacting the sheets stacked on the discharge tray and is smoothly re-conveyed.

Furthermore, another image forming apparatus (hereinafter referred to as a "second image forming apparatus") has been known that includes two discharge rollers to discharge a sheet out of an apparatus main body, a discharge tray to support the sheet discharged by the discharge rollers, and a swingable stack lever to press the sheet discharged on the discharge tray.

SUMMARY

However, in the first image forming apparatus, since an upper side of the stack levers is open, the sheet being conveyed along the re-conveyance path might be conveyed in an unintended direction such as to be away upward from the stack levers, and might not smoothly be re-conveyed.

Further, in the second image forming apparatus, the stack lever is exposed to the outside of the apparatus so as to be easily touched by a user. Therefore, the stack lever might be incorrectly operated by the user. If the stack lever is operated incorrectly, the stack lever may be damaged due to an excessive load applied thereto.

Aspects of the present disclosure are advantageous to provide one or more improved techniques for an image forming apparatus that make it possible to stabilize a posture of a sheet being conveyed along a re-conveyance path and to prevent a stack lever from being operated incorrectly.

According to aspects of the present disclosure, an image forming apparatus is provided, which includes an image forming engine configured to form an image on a sheet, a re-conveyance path configured to guide the sheet, on which the image is formed by the image forming engine, to be switched back and re-conveyed toward the image forming engine, a discharge tray, a discharge path configured to guide the sheet in a sheet discharge direction toward the discharge tray, a stack lever configured to contact a top surface of the sheet on the discharge tray and press the sheet toward the discharge tray, and a guide member configured to form a part of the re-conveyance path, extend up to a position downstream of the stack lever in the sheet discharge direction above the stack lever, and guide the sheet being conveyed along the re-conveyance path, between the guide member and the stack lever.

According to aspects of the present disclosure, further provided is an image forming apparatus including an apparatus main body, a discharge roller configured to discharge a sheet in a sheet discharge direction from the apparatus main body, a discharge tray configured to support the sheet discharged by the discharge roller, a stack lever configured to contact a top surface of the sheet discharged on the discharge tray and press the sheet toward the discharge tray, and a cover removably attachable to the apparatus main body, the cover being configured to, when attached to the apparatus main body, form at least a part of an upper surface of the image forming apparatus and cover the stack lever from above, the cover having a downstream end portion that is positioned downstream of the stack lever in the sheet discharge direction when the cover is attached to the apparatus main body.

According to aspects of the present disclosure, further provided is an image forming apparatus including an apparatus main body, an image forming engine configured to form an image on a sheet, a re-conveyance path configured to guide the sheet, on which the image is formed by the image forming engine, to be switched back and re-conveyed toward the image forming engine, a discharge roller configured to discharge the sheet in a sheet discharge direction from the apparatus main body, a discharge tray configured to support the sheet discharged by the discharge roller, a stack lever configured to contact a top surface of the sheet discharged on the discharge tray and press the sheet toward the discharge tray, and a cover removably attachable to the apparatus main body, the cover being configured to, when attached to the apparatus main body, form at least a part of an upper surface of the image forming apparatus and cover the stack lever from above, the cover including a guide configured to, when the cover is attached to the apparatus main body, serve as a part of the re-conveyance path, extend up to a position downstream of the stack lever in the sheet discharge direction above the stack lever, and guide the sheet being conveyed along the re-conveyance path, between the cover and the stack lever.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

1. First Illustrative Embodiment

Hereinafter, a first illustrative embodiment according to aspects of the present disclosure will be described with reference to FIGS. 1 to 6.

1-1. Overall Configuration of Image Forming Apparatus

Figure 1:
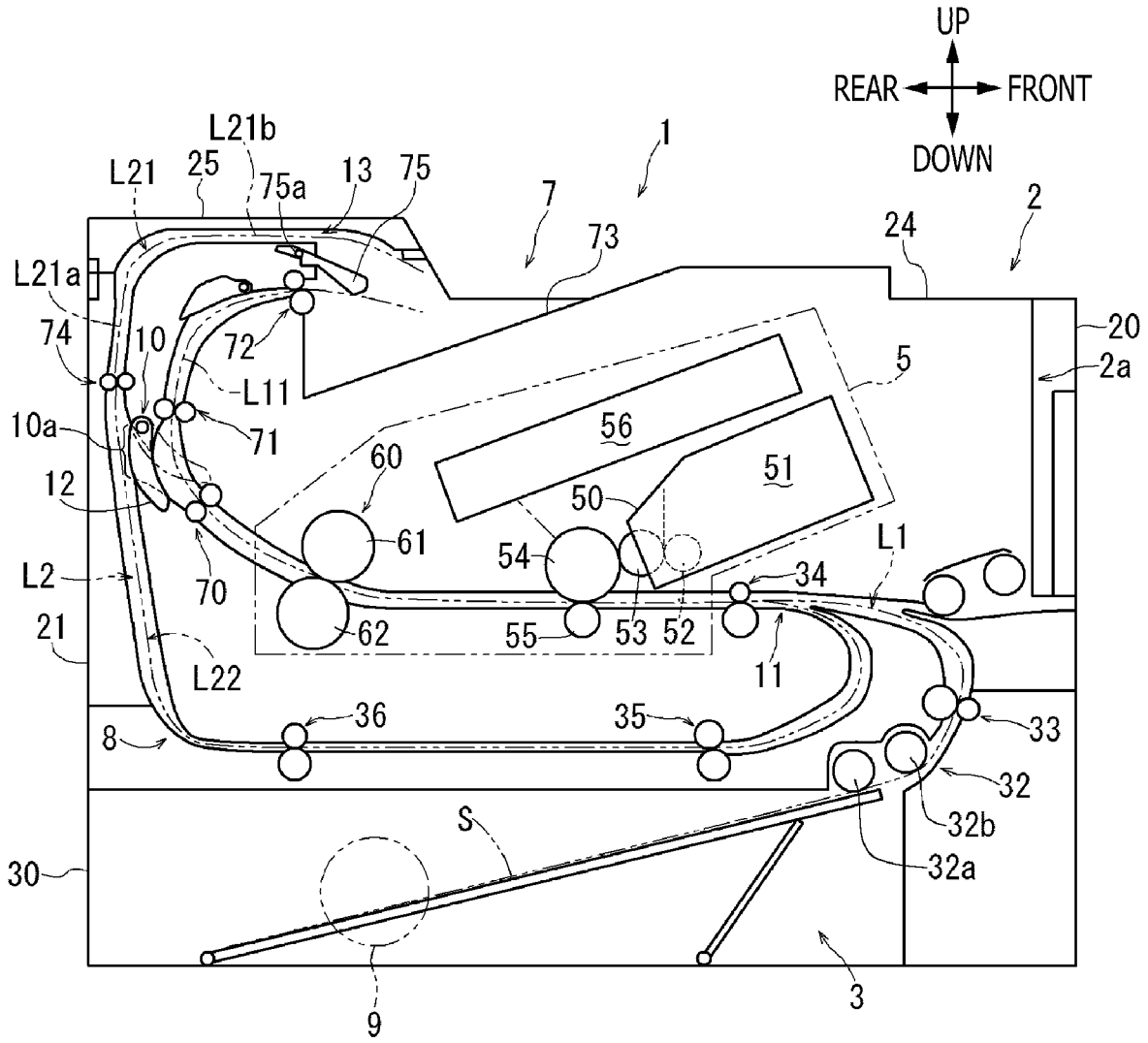
FIG. 1 is a cross-sectional side view schematically showing a configuration of an image forming apparatus in a first illustrative embodiment according to one or more aspects of the present disclosure.
Figure 2:
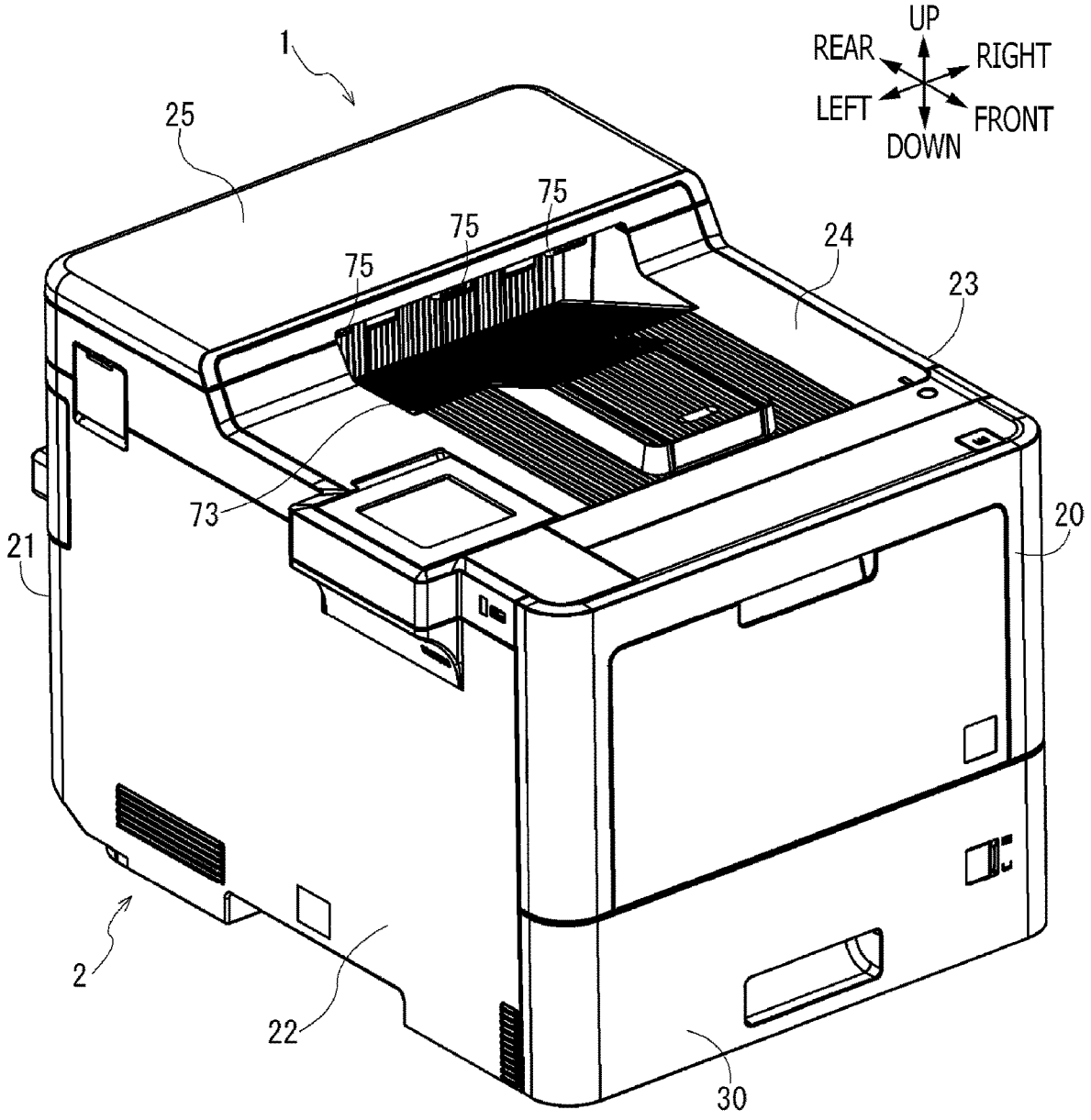
FIG. 2 is a perspective view of the image forming apparatus in the first illustrative embodiment according to one or more aspects of the present disclosure.

As shown in FIGS. 1 and 2, an image forming apparatus 1 of the first illustrative embodiment includes an apparatus main body 2, a sheet feeder 3, an image forming engine 5, a sheet discharger 7, a re-conveyor 8, and a motor 9.

In the following description, a right side in FIG. 1 will be defined as a front side of the image forming apparatus 1. A left side in FIG. 1 will be defined as a rear side of the image forming apparatus 1. A near side with respect to a plane of FIG. 1 will be defined as a left side of the image forming apparatus 1. A far side with respect to the plane of FIG. 1 will be defined as a right side of the image forming apparatus 1. Further, an upper side and a lower side in FIG. 1 will be defined as an upper side and a lower side of the image-forming apparatus 1, respectively.

The apparatus main body 2 contains therein the sheet feeder 3, the image forming engine 5, the sheet discharger 7, the re-conveyor 8, and the motor 9. As shown in FIGS. 1 and 2, the apparatus main body 2 includes a front cover 20, a rear cover 21, a left side cover 22, a right side cover 23, a top cover 24, and a guide member 25. The top cover 24 and the guide member 25 are located at an upper end portion of the apparatus main body 2 and form an upper surface of the image forming apparatus 1. The guide member 25 is disposed at the rear of the top cover 24. It is noted that hereinafter, the guide member 25 may be referred to as the "upper end cover 25."

A front face of the apparatus main body 2 has an opening 2*a*. The front cover 20 is configured to rotate between a closed position to close the opening 2*a* and an open position to open the opening 2*a*.

The sheet feeder 3 is disposed at a lower portion of the apparatus main body 2. The sheet feeder 3 is configured to convey sheets S set in a sheet cassette 30 to the image forming engine 5. The image forming engine 5 is disposed downstream of the sheet feeder 3 in a sheet conveyance direction. The image forming engine 5 is configured to form an image on each of the sheets S fed from the sheet feeder 3. The sheet discharger 7 is disposed downstream of the image forming engine 5 in the sheet conveyance direction. The sheet discharger 7 is configured to discharge a sheet S with an image formed thereon by the image forming engine 5, to the outside of the image forming apparatus 1.

The image forming apparatus 1 has a sheet conveyance path L1 extending from the sheet feeder 3 to the sheet discharger 7 via the image forming engine 5. The sheet feeder 3 includes the sheet cassette 30 configured to support the sheets S set therein, a sheet feeding mechanism 32, two conveyance rollers 33, and two registration rollers 34.

The sheet feeding mechanism 32 includes a pickup roller 32*a* and a separation roller 32*b*. The pickup roller 32*a* is configured to feed the sheets set in the sheet cassette 30 toward the separation roller 32*b*. The separation roller 32*b* is disposed downstream of the pickup roller 32*a* in the sheet conveyance direction.

Sheets S fed to the separation roller 32*b* by the pickup roller 32*a* are separated on a sheet-by-sheet basis between the separation roller 32*b* and a separation pad (not shown). The individual sheets S separated on the sheet-by-sheet basis are conveyed toward the conveyance rollers 33, along the sheet conveyance path L1.

The two conveyance rollers 33 are configured to provide a conveyance force to the individual separated sheets S. The conveyance rollers 33 are disposed downstream of the sheet feeding mechanism 32 in the sheet conveyance direction. Each of the sheets S, conveyed from the sheet feeding mechanism 32 to the conveyance rollers 33, is conveyed by the conveyance rollers 33, toward the registration rollers 34 along the sheet conveyance path L1.

The two registration rollers 34 are disposed downstream of the conveyance rollers 33 in the sheet conveyance direction. The registration rollers 34 are configured to once stop the movement of a leading end of a sheet S being conveyed, thereby correcting a posture of the sheet S. After correcting the posture of the sheet S, the registration rollers 34 convey the sheet S toward a transfer position of the image forming engine 5 at particular timing.

The image forming engine 5 is disposed above the sheet cassette 30. The image forming engine 5 includes a process cartridge 60, an exposure unit 56, and a fuser 60. The process cartridge 50 is configured to transfer an image onto a surface of a sheet S conveyed by the sheet feeder 3. The exposure unit 56 is configured to expose a surface of a photoconductive drum 54 of the process cartridge 50. The fuser 60 is configured to fix the image transferred on the sheet S by the process cartridge 50.

The process cartridge 50 includes a developer container 51, a supply roller 52, a development roller 53, the photoconductive drum 54, and a transfer roller 55. The exposure unit 56 includes a laser diode, a polygon mirror, a lens, and a reflecting mirror. The exposure unit 56 exposes the surface of the photoconductive drum 54 by emitting laser light toward the photoconductive drum 54 based on image data input to the image forming apparatus 1.

The developer container 51 contains therein toner as developer. The toner stored in the developer container 51 is sent to the supply roller 52 while being agitated by an agitator (not shown). The supply roller 52 supplies the toner sent from the developer container 51, to the development roller 53.

The development roller 53 is disposed in close contact with the supply roller 52. The development roller 53 is configured to carry thereon the toner supplied from the supply roller 52 and charged by a slide contact member (not shown). Further, to the development roller 53, a development bias is applied by a bias applying device (not shown).

The photoconductive drum 54 is disposed adjacent to the development roller 53. A surface of the photoconductive drum 54 is uniformly positively charged by a charger (not shown), and thereafter exposed by the exposure unit 56. An exposed portion of the photoconductive drum 54 has a lower potential than the other portions. Thus, an electrostatic latent image based on the image data is formed on the photoconductive drum 54. When positively charged toner is supplied from the development roller 53 to the surface of the photoconductive drum 54 on which the electrostatic latent image is formed, the electrostatic latent image is visualized to be a developer image.

The transfer roller 55 is opposed to the photoconductor drum 54. To a surface of the transfer roller 55, a negative transfer bias is applied by a bias applying device (not shown). When a sheet S is conveyed while being held in a transfer position between the photoconductive drum 54 with the developer image formed thereon and the transfer roller 55 with the transfer bias applied thereto, the developer image on the surface of the photoconductive drum 54 is transferred onto a surface of the sheet S.

The fuser 60 includes a heating roller 61 and a pressing roller 62. The heating roller 61 is driven to rotate by a driving force from the motor 9, and is heated when supplied with electric power from a power supply (not shown). The pressing roller 62 is opposed to the heating roller 61. According to the rotation of the heating roller 61, the pressing roller 62 is driven to rotate in close contact with the heating roller 61. When the sheet S with the developer image transferred thereon is conveyed to the fuser 60, the fuser 60 further conveys the sheet S while holding the sheet S between the heating roller 61 and the pressing roller 62, and fixes the developer image onto the sheet S.

The sheet discharger 7 includes two first intermediate discharge rollers 70, two second intermediate discharge rollers 71, two discharge rollers 72, and a discharge tray 73. The first intermediate discharge rollers 70 and the second intermediate discharge rollers 71 are disposed downstream of the image forming engine 5 in the sheet conveyance direction. The first intermediate discharge rollers 70 and the second intermediate discharge rollers 71 further convey the sheet S conveyed from the fuser 60, toward the discharge rollers 72.

The two discharge rollers 72 are configured to further convey the sheet S conveyed by the first intermediate discharge rollers 70 and the second intermediate discharge rollers 71, thereby discharging the sheet S out of the apparatus main body 2. The discharge tray 73 is formed in the top cover 24. The discharge tray 73 is configured to support the sheet S discharged out of the apparatus main body 2 by the discharge rollers 72.

The sheet S, discharged out of the apparatus main body 2 onto the discharge tray 73 by the discharge rollers 72, is conveyed along a discharge path L11. The discharge path L11 branches off from the conveyance path L1 at a bifurcation 10 located between the first intermediate discharge rollers 70 and the second intermediate discharge rollers 71 in the sheet conveyance direction (i.e., a sheet discharge direction). The discharge path L11 is a path through which the sheet S to be discharged onto the discharge tray 73 passes.

The image forming apparatus 1 includes a plurality of swingable stack levers 75 arranged along the left-to-right direction. Specifically, in the first illustrative embodiment, the stack levers 75 are disposed at respective three locations, i.e., a left end portion, a right end portion, and a middle portion of the discharge tray 73 in the left-to-right direction. Each stack lever 75 is configured to contact the sheet S discharged onto the discharge tray 73 via the discharge path L11 by the discharge rollers 72 and press the sheet S toward the discharge tray 73.

1-2. Re-conveyance Path

The image forming apparatus 1 has a re-conveyance path L2 for re-conveying, toward the image forming engine 5, a sheet S conveyed downstream in the sheet conveyance direction from the image forming engine 5. In the image forming apparatus 1, for instance, when duplex printing is performed on a sheet S, the sheet S is conveyed downstream in the sheet conveyance direction from the image forming engine 5, and is conveyed again toward the image forming engine 5 via the re-conveyance path L2. The re-conveyance path L2 includes a first path L21 and a second path L22.

The first path L21 is located at the rear of the image forming engine 5. The first path L21 is configured to, when duplex printing is performed on the sheet S, switch back the sheet S conveyed from the image forming engine 5 and invert a leading end and a trailing end of the sheet S. A part of the first path L21 is formed by the guide member 25 of the apparatus main body 2. In other words, the guide member 25 has a part (see e.g., a below-mentioned path L21*b*) of the first path L21.

The first path L21 branches off from the conveyance path L1 at the bifurcation 10 between the first intermediate discharge rollers 70 and the second intermediate discharge rollers 71. The first path L21 extends upward from the bifurcation 10 and then bends forward. An end of the first path L21 that is different from the other end thereof (i.e., the bifurcation 10) is an opening 13 open to the outside of the apparatus main body 2. The first path L21 is configured such that, when the sheet S is introduced into the first path L 21 and conveyed from the bifurcation 10 toward the opening 13, a portion of the sheet S that does not fit within the first path L 21 extends from the opening 13 to the outside of the apparatus main body 2.

The second path L22 branches off from the conveyance path L1 at the bifurcation 10 and joins the conveyance path L1 at a confluence 11 positioned between the transfer rollers 33 and the registration rollers 34 along the conveyance path L1. The second path L22 extends downward from the bifurcation 10, then bends forward, and further bends upward to the confluence 11. The second path L22 is connected with the first path L21 at the bifurcation 10. Thus, the sheet S switched back on the first path L21 is enabled to be introduced into the second path L22.

The first path L21 has two switchback rollers 74 disposed therealong. The switchback rollers 74 are configured to switch their rotational directions between a forward direction and a backward direction. Specifically, the switchback rollers 74 are driven to rotate in the forward direction to introduce the sheet S into the first path L21. Further, the switchback rollers 74 are driven to rotate in the backward direction to convey the sheet S from the first path L21 to the second path L22. The sheet S conveyed to the second path L22 is further conveyed toward the image forming engine 5 by two second re-conveyance rollers 36 and two first re-conveyance rollers 35 disposed along the second path L22.

Thus, the image forming apparatus 1 is configured to perform duplex printing, by again conveying the sheet S, of which an image has been formed on a first surface by the image forming engine 5 disposed along the conveyance path L1, toward the image forming engine 5 via the first path L21 and the second path L22 of the re-conveyance path L2, and causing the image forming engine 5 to form an image on a second surface of the sheet S.

1-3. Switchback Mechanism

As shown in FIG. 1, the image forming apparatus 1 includes a flapper 12 disposed at the bifurcation 10. The flapper 12 is configured to swing relative to the apparatus main body 2, thereby switching a path for the sheet S conveyed from the conveyance path L1 between the discharge path L11 and the re-conveyance path L2 at the bifurcation 10.

When guiding the sheet S conveyed from the fuser 60 to the discharge tray 73 along the discharge path L11, the flapper 12 is placed in a discharge position (i.e., a position shown by a solid line in FIG. 1). In this case, the flapper 12 in the discharge position closes the opening 10*a* leading to the re-conveyance path L2. Further, when guiding the sheet S conveyed from the fuser 60 to the re-conveyance path L2, the flapper 12 is swung to a re-conveyance position (i.e., a position shown by an alternate long and two short dashes line in FIG. 1) that is forward of the discharge position. In this case, the flapper 12 in the re-conveyance position opens the opening 10*a* and closes the discharge path L11 leading to the discharge tray 73.

Specifically, when the flapper 12 is in the re-conveyance position, the sheet S fed into the opening 10*a* from the transfer path L1 is conveyed rearward and obliquely upward and introduced into the first path L21 of the re-conveyance path L2. The sheet S introduced into the first path L21 is held between the two switchback rollers 74, and further fed into the first path L21 until an entire length of the sheet S in the sheet conveyance direction passes through the opening 10*a*.

Then, after the entire length of the sheet S has passed through the opening 10*a*, the rotational direction of each switchback roller 74 is reversed, and the sheet S is conveyed from the first path L21 to the second path L22. At this time, the flapper 12 is swung from the re-conveyance position to the discharge position, and the opening 10*a* is closed. Subsequently, the sheet S is conveyed along the second path L22, from the switchback rollers 74 to the first re-conveyance rollers 35 through the second re-conveyance rollers 36, and is reintroduced into the conveyance path L1 via the confluence 11.

1-4. Stack Levers

Figure 3:
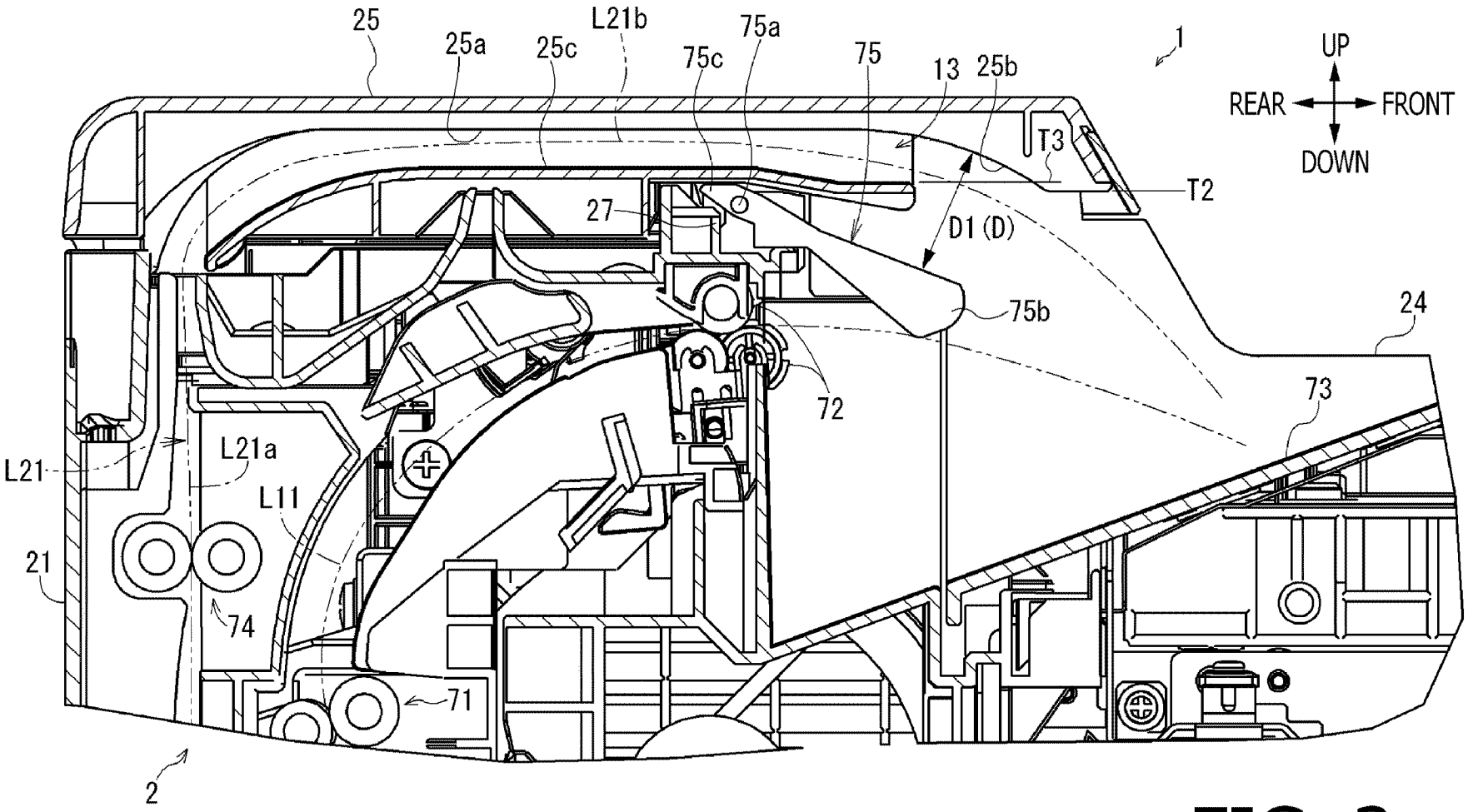
FIG. 3 is a cross-sectional side view showing a configuration around a sheet discharger of the image forming apparatus when each stack lever is in a second position, in the first illustrative embodiment according to one or more aspects of the present disclosure.
Figure 4:
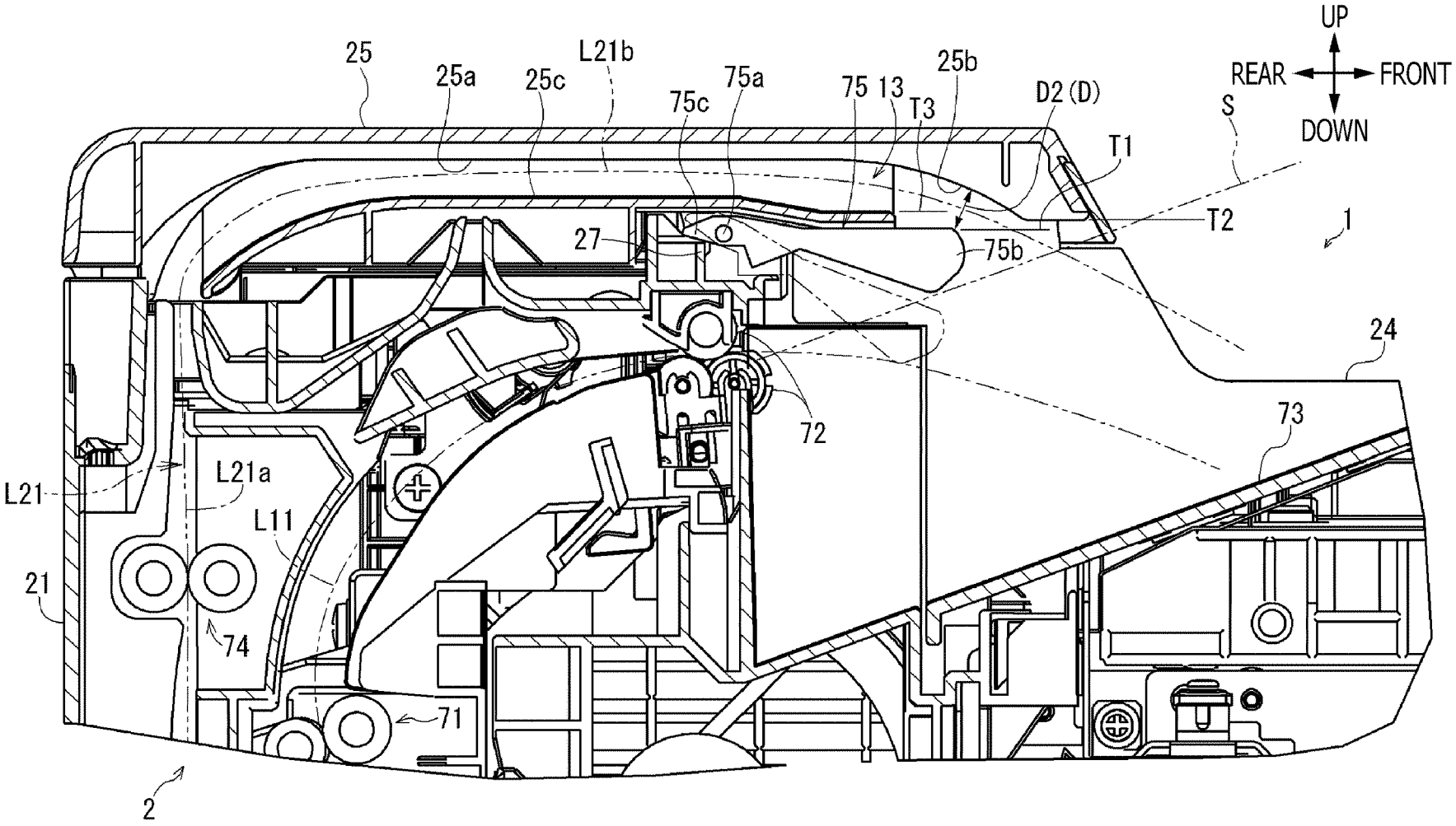
FIG. 4 is a cross-sectional side view showing a configuration around the sheet discharger of the image forming apparatus when each stack lever is in a first position, in the first illustrative embodiment according to one or more aspects of the present disclosure.

As shown in FIGS. 3 and 4, each of the stack levers 75 is configured to swing vertically around a rotational shaft 75*a* disposed at a rear end of each stack lever 75. Each stack lever 75 is placed in a second position (i.e., a lower position shown in FIG. 3) by its own weight when there is no sheet S discharged on the discharge tray 73. In this state, a tip portion 75*b* of each stack lever 75 is not in contact with the discharge tray 73 and is separated upward from the discharge tray 73. The tip portion 75*b* of each stack lever 75 is a downstream end portion of each stack lever 75 in the sheet discharge direction, and is located downstream of the rotational shaft 75*a* in the sheet discharge direction.

When sheets S are discharged onto the discharge tray 73, and the sheets S are stacked on the discharge tray 73, a top surface of the stacked sheets S contacts the tip portion 75*b* of each stack lever 75. The tip portion 75*b* of each stack lever 75 is pushed up when contacting the top surface of the stacked sheets S. Thereby, each stack lever 75 moves upward from the second position. When the sheets S stacked on the discharge tray 73 are fully loaded, each stack lever 75 moves to a first position (i.e., an upper position shown by a solid line in FIG. 4). As shown in FIGS. 3 and 4, when each stack lever 75 is in the first position, the tip portion 75*b* is located higher than when each stack lever 75 is in the second position.

When in the first position, each stack lever 75 is restricted from swinging upward any further. Specifically, each stack lever 75 includes a locking portion 75*c* at the rear of the rotational shaft 75*a*. The apparatus main body 2 includes a locked portion 27 configured to engage with the locking portion 75*c*. When each stack lever 75 is moved to the first position, the locking portion 75*c* comes into engagement with the locked portion 27. Thereby, each stack lever 75 is restricted from swinging upward any further.

The first position of each stack lever 75 is an upper end position of a moving range of each stack lever 75 in the vertical direction. The second position of each stack lever 75 is a lower end position of the moving range of each stack lever 75 in the vertical direction. In other words, each stack lever 75 is configured to move between the first position and the second position in the vertical direction.

When the top surface of the sheets S stacked on the discharge tray 73 is in contact with the tip portion 75*b* of each stack lever 75, and each stack lever 75 is moved higher than the second position, the sheets S stacked on the discharge tray 73 are pressed toward the discharge tray 73 by the weights of the stack levers 75.

1-5. Guide Member

As shown in FIGS. 3 and 4, the guide member 25 is attached to an upper end portion of the apparatus main body 2. The guide member 25 is located above the stack levers 75 and covers the stack levers 75 from above. The guide member 25 extends up to a position downstream of the stack levers 75 in the sheet discharge direction, above the stack levers 75. In other words, a downstream end portion of the guide member 25 is located downstream of the stack levers 75 in the sheet discharge direction.

The first path L21 of the re-conveyance path L2 has a path L21*a* and a path L21*b*. The path L21*a* extends upward from the bifurcation 10. The path L21*b* bends and extends forward from an upper end of the path L21*a*. The guide member 25 has an upper path surface 25*a* to form an upper surface of the path L21*b* and a lower path surface (hereinafter, which may be referred to as a "second guide surface") 25*c* to form a lower surface of the path L21*b*. In other words, the pathway L21*b* is defined by the upper path surface 25*a* and the lower path surface 25*c*.

The opening 13 of the first path L21 is located at a downstream end of the path L21*b* in the sheet discharge direction. The tip portion 75*b* of each stack lever 75 is located downstream of the opening 13 of the first path L21 in the sheet discharge direction.

The downstream end portion of the guide member 25 in the sheet discharge direction has a first guide surface 25*b*. The first guide surface 25*b* is configured to guide the sheet S being conveyed along the first path L21, toward the discharge tray 73, between the first guide surface 25*b* and the stack levers 75. The first guide surface 25*b* is located downstream of the upper path surface 25*a* in the sheet discharge direction, and is opposed to the tip portion 75*b* of each stack lever 75 substantially in the vertical direction.

Thus, the image forming apparatus 1 is configured to guide the sheet S being conveyed downstream in the sheet discharge direction along the first path L21, between the first guide surface 25*b* of the guide member 25 and the stack levers 75. Accordingly, it is possible to prevent the sheet S from being conveyed in an unintentional direction, for instance, in such a case that the image forming apparatus 1 does not include the guide member 25 and that an upper side of the stack levers 75 is open. Thus, it is possible to stabilize a posture of the sheet S being conveyed along the first path L21.

In particular, the first guide surface 25*b* of the guide member 25 is configured to guide the sheet S being conveyed along the first path L 21 toward the discharge tray 73. Therefore, the sheet S, which is being conveyed downstream in the sheet discharge direction along the first path L21, is not excessively conveyed forward while floating upward from the discharge tray 73. Thus, it is possible to keep the user from touching the sheet S that is to be switched back.

Further, the first guide surface 25*b* is disposed to face the tip portion 75*b* of each stack lever 75 substantially in the vertical direction. Therefore, the sheet S being guided toward the discharge tray 73 along the first guide surface 25*b* comes into contact with the tip portion 75*b* of each stack lever 75, and is prevented from going too far toward the discharge tray 73.

If the sheet S being guided along the first guide surface 25*b* goes too far toward the discharge tray 73, an angle of contact between the guided sheet S and the top surface of the sheets S stacked on the discharge tray 73 might be too large such that some of the sheets S stacked on the discharge tray 73 are pushed forward.

However, in the image forming apparatus 1, the sheet S being guided along the first guide surface 25*b* comes into contact with the tip portion 75*b* of each stack lever 75, and is prevented from going too far toward the discharge tray 73. Hence, it is possible to prevent the angle of the contact between the guided sheet S and the sheets S stacked on the discharge tray 73 from being too large and to maintain alignment of the sheets S stacked on the discharge tray 73.

In this case, a distance D between each stack lever 75 and the first guide surface 25*b* of the guide member 25 varies with an angle of rotation of each stack lever 75. The distance D between each stack lever 75 and the first guide surface 25*b* becomes shorter as the number of the sheets S stacked on the discharge tray 73 increases. For instance, a distance D2 (see FIG. 4) between each stack lever 75 and the first guide surface 25*b* when there are sheets S stacked on the discharge tray 73 is shorter than a distance D1 (see FIG. 3) between each stack lever 75 and the first guide surface 25*b* when there is no sheet S on the discharge tray 73.

Hence, when sheets S are stacked on the discharge tray 73, it is possible to locate a contact point, in which the sheet S to be switched back, when being conveyed downstream in the sheet discharge direction, comes in contact with the top surface of the sheets S stacked on the discharge tray 73, to be far from the first path L21. Thus, it is possible to maintain the alignment of the sheets S stacked on the discharge tray 73.

Further, the first guide surface 25*b* has such a curved shape as to approach the discharge tray 73 as going downstream in the sheet discharge direction and concave upward. Thus, the first guide surface 25*b* is configured to guide the sheet S being conveyed along the first path L21 toward the discharge tray 73.

Thereby, regardless of where the sheet S being conveyed along the first path L21 comes into contact with the first guide surface 25*b*, it is possible to make small an angle of contact between the sheet S and the first guide surface 25*b*. Thus, it is possible to prevent the sheet S from being bent due to the contact with the first guide surface 25*b*.

However, the first guide surface 25*b* may have a shape other than the curved shape as long as the first guide surface 25*b* is formed to approach the discharge tray 73 as going downstream in the sheet discharge direction. For instance, the first guide surface 25*b* may be an inclined surface formed to approach the discharge tray 73 as going downstream in the sheet discharge direction. Thus, when the first guide surface 25*b* is formed to approach the discharge tray 73 as going downstream in the sheet discharge direction, the first guide surface 25*b* is enabled to guide the sheet S being conveyed along the first path L21 toward the discharge tray 73.

When each stack lever 75 is in the first position, the tip portion 75*b* of each stack lever 75 is closer to the first guide surface 25*b*. When each stack lever 75 is in the second position, the tip portion 75*b* of each stack lever 75 is farther from the first guide surface 25*b* than when each stack lever 75 is in the first position.

In the vertical direction, a position T1 of an upper end of each stack lever 75 in the first position is as high as or lower than a position T2 of a lower end of the first guide surface 25*b*. In other words, the upper end of each stack lever 75 in the first position is vertically positioned as high as or lower than the lower end of the first guide surface 25*b*. As shown in FIG. 4, in the first illustrative embodiment, the position T1 of the upper end of each stack lever 75 in the first position is lower than the position T2 of the lower end of the first guide surface 25*b*.

If the position T1 of the upper end of each stack lever 75 in the first position were higher than the position T2 of the lower end of the first guide surface 25*b*, a degree of pressing force applied by each stack lever 75 onto the sheet S, which is being guided by the first guide surface 25*b* toward the discharge tray 73, might be too large such that a bending tendency is formed on the sheet S.

However, in the image forming apparatus 1, the position T1 of the upper end of each stack lever 75 in the first position is as high as or lower than the position T2 of the lower end of the first guide surface 25*b*. Therefore, the degree of pressing force applied by each stack lever 75 onto the sheet S, which is being guided by the first guide surface 25*b* toward the discharge tray 73, is never too large. Thus, it is possible to prevent the bending tendency from being formed on the sheet S.

As shown in FIG. 3, a downstream end of the lower path surface 25*c* in the sheet discharge direction is located in a position T3 in the vertical direction. The position T2 of the lower end of the first guide surface 25*b* is lower than the position T3 of the lower path surface 25*c*. In other words, the lower end of the first guide surface 25*b* is located closer to the discharge tray 73 than the downstream end of the lower path surface 25*c* in the sheet discharge direction is. Accordingly, the first guide surface 25*b* is enabled to effectively guide the sheet S, which is being conveyed downstream in the sheet discharge direction along the first path L21, toward the discharge tray 73.

Figure 5:
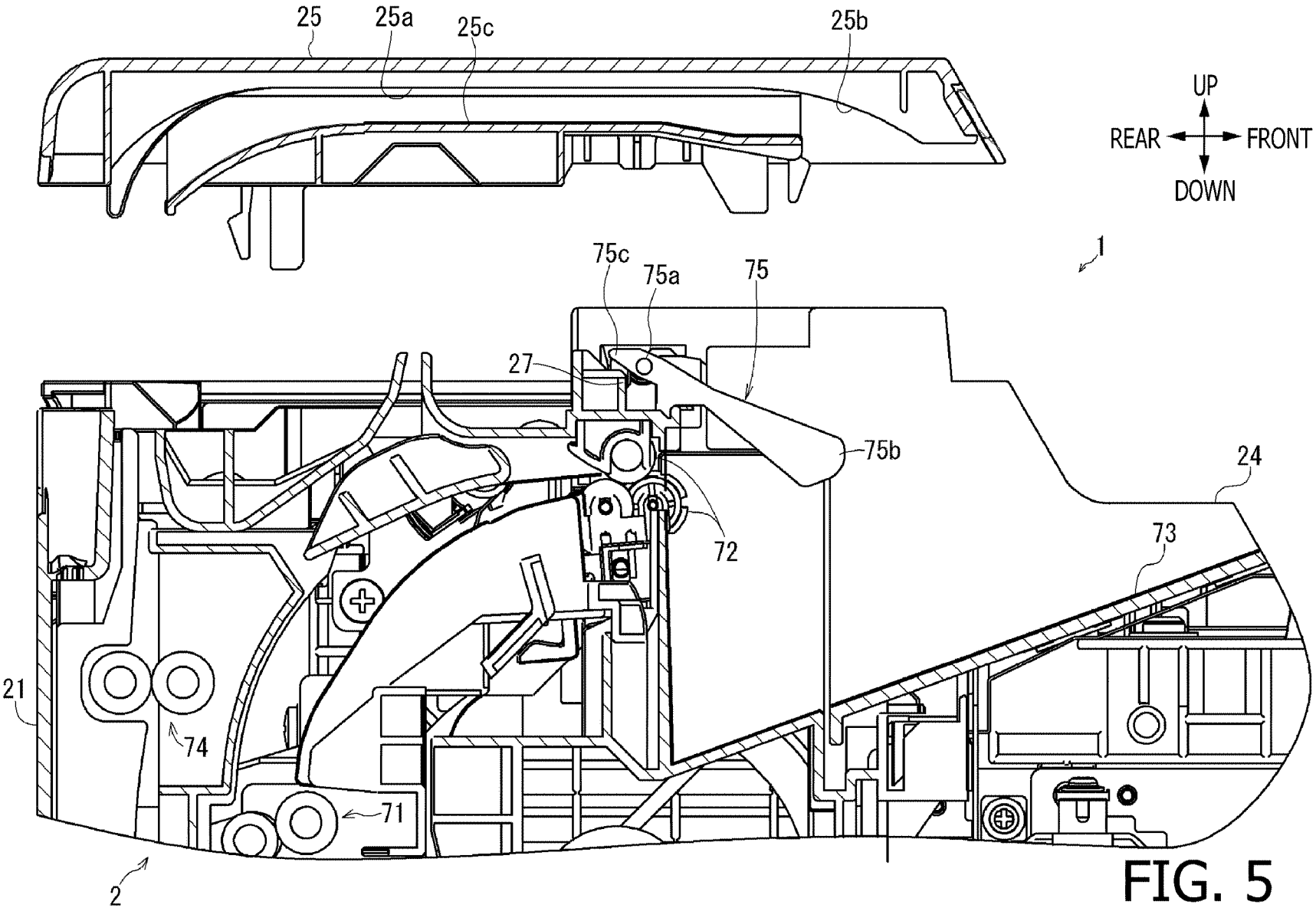
FIG. 5 is a cross-sectional side view showing a configuration around the sheet discharger of the image forming apparatus when a guide member is removed from an apparatus main body, in the first illustrative embodiment according to one or more aspects of the present disclosure.

The guide member 25 is detachably attached to the upper end of the apparatus main body 2. The guide member 25 is configured to switch its state between a covering state (see FIGS. 3 and 4) and an open state (see FIG. 5). As shown in FIGS. 3 and 4, in the covering state, the guide member 25 is attached to the apparatus main body 2 and covers the upper side of the stack levers 75. As shown in FIG. 5, in the open state, the guide member 25 is detached from the apparatus main body 2, and the upper side of the stack levers 75 is open.

Thus, the guide member 25 is switchable between the covering state and the open state. Hence, for instance, when the sheet S being conveyed along the first path L21 is jammed, by removing the guide member 25 from the apparatus main body 2 and switching the guide member 25 to the open state, the user is allowed to more efficiently deal with the sheet jam.

1-6. Modifications

In the aforementioned first illustrative embodiment, the guide member 25 is detachably attached to the apparatus main body 2. However, the guide member 25 is not limited to the one configured as above, as long as the guide member 25 is switchable between the covering state and the open state. For instance, the guide member 25 may be rotatably attached to the apparatus main body 2.

Figure 6:
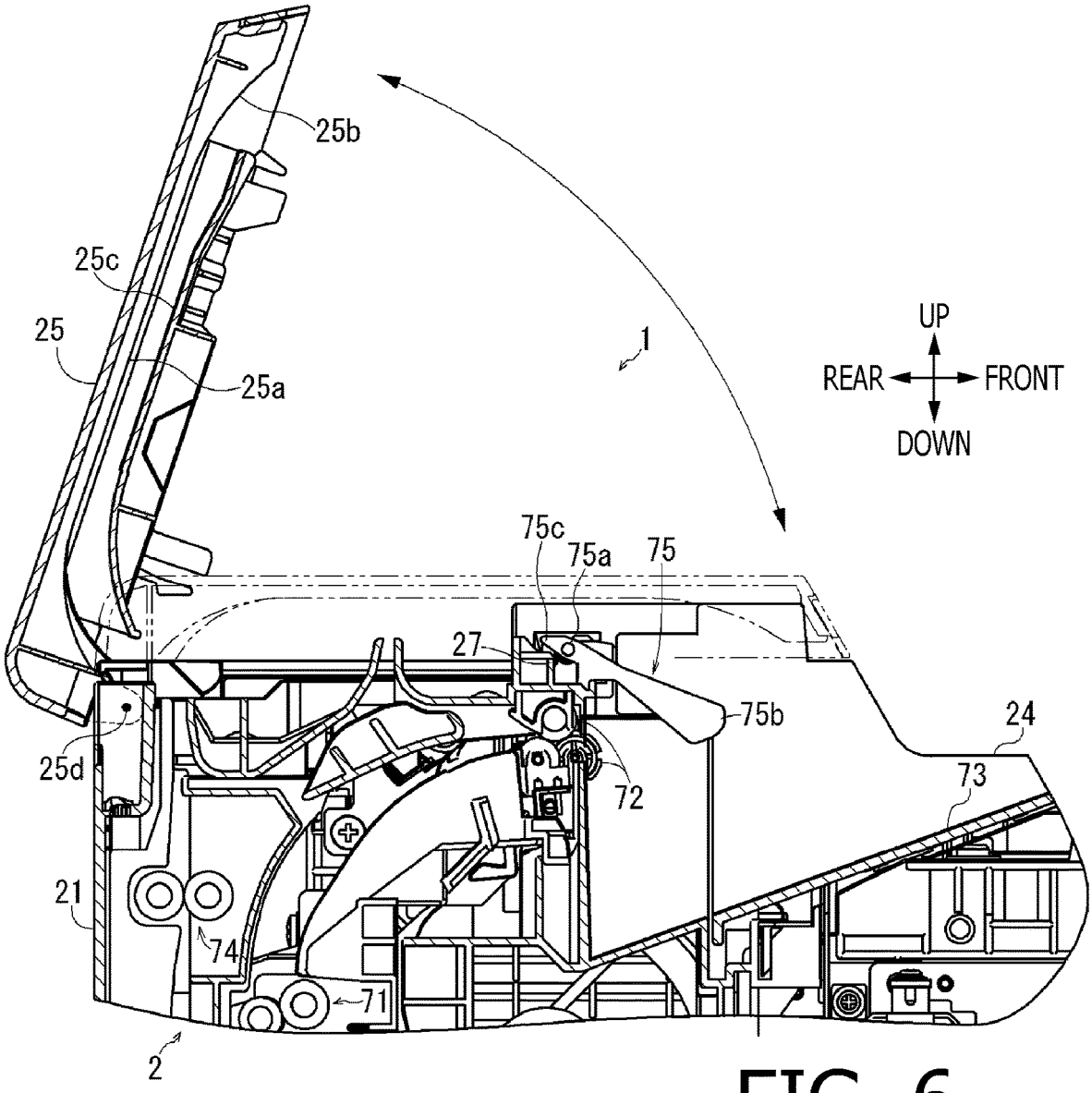
FIG. 6 is a cross-sectional side view showing a configuration of an image forming apparatus when a guide member is rotatably attached to an apparatus main body, in a modification according to one or more aspects of the present disclosure.

The guide member 25 shown in FIG. 6 is attached to the apparatus main body 2, to be rotatable around a rotational axis 25*d* positioned at a rear end portion of the guide member 25. In this case, as indicated by an alternate long and two short dashes line in FIG. 6, the guide member 25 is switched to the covering state when rotated downward. Further, as indicated by a solid line in FIG. 6, the guide member 25 is switched to the open state when rotated upward.

2. Second Illustrative Embodiment

Subsequently, a second illustrative embodiment according to aspects of the present disclosure will be described with reference to FIGS. 7 to 15. In the following description, substantially the same elements as in the aforementioned first illustrative embodiment will be provided with the same reference characters, and detailed explanations thereof may be omitted.

2-1. Overall Configuration of Image Forming Apparatus

Figure 7:
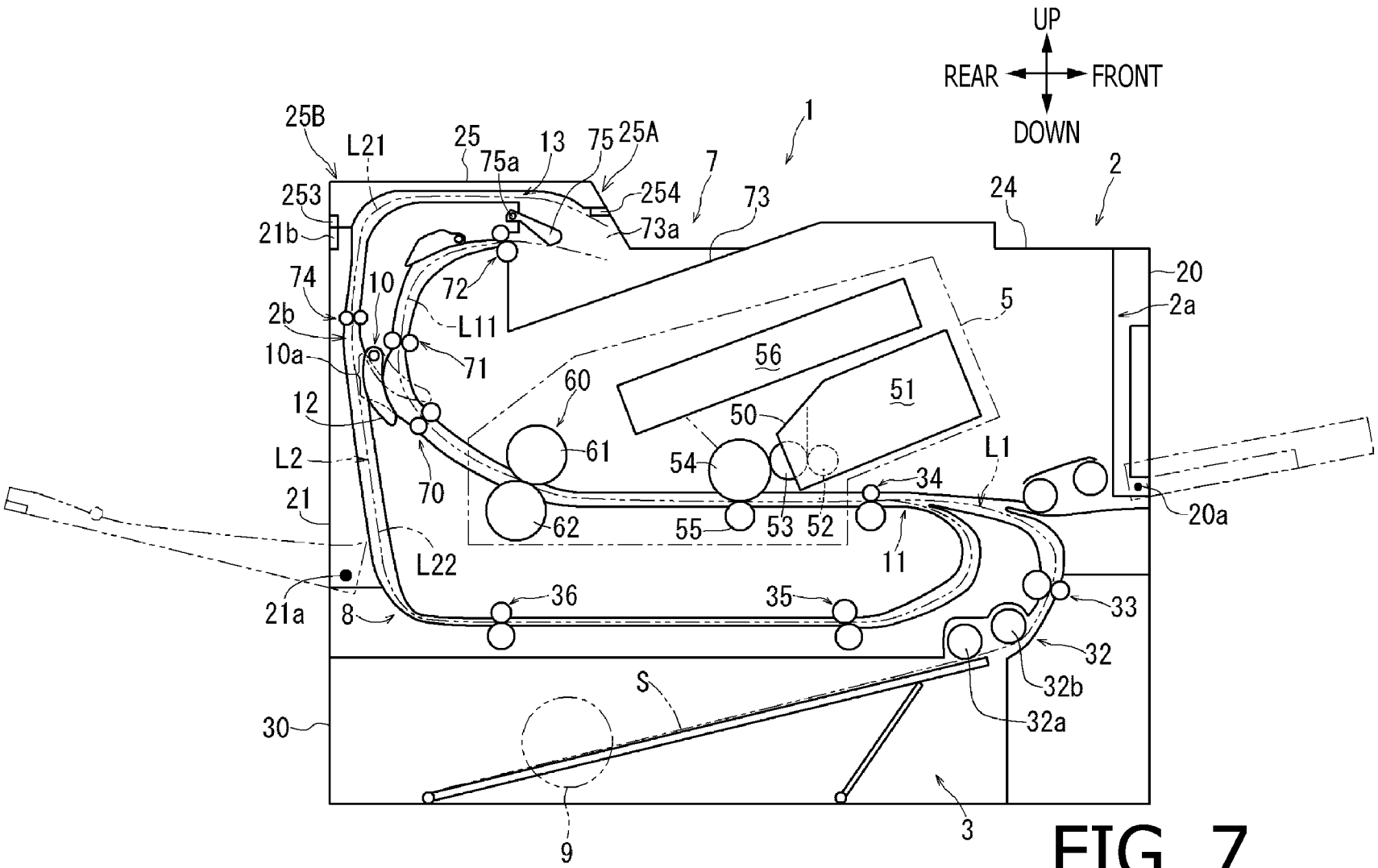
FIG. 7 is a cross-sectional side view showing a configuration of an image forming apparatus in a second illustrative embodiment according to one or more aspects of the present disclosure.

As shown in FIG. 7, an image forming apparatus 1 of the second illustrative embodiment includes an apparatus main body 2, a sheet feeder 3, an image forming engine 5, a sheet discharger 7, a re-conveyor 8, and a motor 9.

In the same manner as in the aforementioned illustrative embodiment, a right side in FIG. 7 will be defined as a front side of the image forming apparatus 1. A left side in FIG. 7 will be defined as a rear side of the image forming apparatus 1. A near side with respect to a plane of FIG. 7 will be defined as a left side of the image forming apparatus 1. A far side with respect to the plane of FIG. 7 will be defined as a right side of the image forming apparatus 1. Further, an upper side and a lower side in FIG. 7 will be defined as an upper side and a lower side of the image-forming apparatus 1, respectively.

The apparatus main body 2 contains therein the sheet feeder 3, the image forming engine 5, the sheet discharger 7, the re-conveyor 8, and the motor 9. As shown in FIGS. 7 to 10, the apparatus main body 2 includes a front cover 20, a rear cover 21, a left side cover 22, a right side cover 23, a top cover 24, and an upper end cover 25. It is noted that the element corresponding to the upper end cover 25 is referred to as the "guide member 25" in the aforementioned first illustrative embodiment and that the upper end cover 25 may have substantially the same configuration as the guide member 25. In other words, the upper end cover 25 may have the configuration of the guide member 25 as described in detail above, and the guide member 25 may have the configuration of the upper end cover 25 as will be described in detail below. The top cover 24 and the upper end cover 25 are located at an upper end portion of the apparatus main body 2 and form an upper surface of the image forming apparatus 1. The upper end cover 25 is disposed at the rear of the top cover 24.

A front face of the apparatus main body 2 has an opening 2*a*. The front cover 20 is configured to rotate around a rotational axis 20*a* positioned at a lower end portion of the front cover 20, thereby moving between a closed position (i.e., a position indicated by a solid line in FIG. 7) to close the opening 2*a* and an open position (i.e., a position indicated by an alternate long and two short dashes line in FIG. 7) to open the opening 2*a*.

A rear face of the apparatus main body 2 has an opening 2*b*. The rear cover 21 is configured to rotate around a rotational axis 21*a* positioned at a lower end portion of the rear cover 21, thereby moving between a closed position (i.e., a position indicated by a solid line in FIG. 7) to close the opening 2*b* and an open position (i.e., a position indicated by an alternate long and two short dashes line in FIG. 7) to open the opening 2*b*.

In the image forming apparatus 1, when the rear cover 21 is moved to the open position, a below-mentioned re-conveyance path L2 is exposed to the outside of the apparatus main body 2 through the opening 2*b*. Thereby, even when a sheet S is jammed on the re-conveyance path L2, it is easy for a user to deal with the jam. Namely, the rear cover 21 serves as a cover that allows the user to, when a sheet jam occurs, open the opening 2*b* and deal with the sheet jam through the opening 2*b*. The rear cover 21 may be an example of a rotatable cover having a side surface of the apparatus main body 2. Examples of the rotatable cover having the side surface of the apparatus main body 2 may include a rotatable feed tray such as a rear tray.

The sheet feeder 3 is disposed at a lower portion of the apparatus main body 2. The sheet feeder 3 is configured to convey sheets S set in a sheet cassette 30 to the image forming engine 5. The image forming engine 5 is disposed downstream of the sheet feeder 3 in a sheet conveyance direction. The image forming engine 5 is configured to form an image on each of the sheets S fed from the sheet feeder 3. The sheet discharger 7 is disposed downstream of the image forming engine 5 in the sheet conveyance direction. The sheet discharger 7 is configured to discharge a sheet S with an image formed thereon by the image forming engine 5, to the outside of the image forming apparatus 1. The image forming apparatus 1 has a sheet conveyance path L1 extending from the sheet feeder 3 to the sheet discharger 7 via the image forming engine 5. Since the sheet feeder 3, the image forming engine 5, and the sheet discharger 7 have substantially the same configurations as those in the aforementioned first illustrative embodiment, detailed explanations thereof will be omitted.

2-2. Re-conveyance Path

The image forming apparatus 1 has a re-conveyance path L2 for re-conveying, toward the image forming engine 5, a sheet S conveyed downstream in the sheet conveyance direction from the image forming engine 5. In the image forming apparatus 1, for instance, when duplex printing is performed on a sheet S, the sheet S is conveyed downstream in the sheet conveyance direction from the image forming engine 5, and is conveyed again toward the image forming engine 5 via the re-conveyance path L2. Since the re-conveyance path L2 has substantially the same configuration as that in the aforementioned first illustrative embodiment, a detailed explanation thereof will be omitted.

2-3. Switchback Mechanism

As shown in FIG. 7, the image forming apparatus 1 includes a flapper 12 disposed at a bifurcation 10. The flapper 12 is configured to swing relative to the apparatus main body 2, thereby switching a path for the sheet S conveyed from the conveyance path L1 between the discharge path L11 and the re-conveyance path L2 at the bifurcation 10. Since the switching mechanism including the flapper 12 has substantially the same configuration as that in the aforementioned first illustrative embodiment, a detailed explanation thereof will be omitted.

2-4. Stack Levers

The image forming apparatus 1 includes a plurality of swingable stack levers 75 arranged along the left-to-right direction. Specifically, in the second illustrative embodiment as well, the stack levers 75 are disposed at respective three locations, i.e., a left end portion, a right end portion, and a middle portion of the discharge tray 73 in the left-to-right direction. Each stack lever 75 is configured to contact the sheet S discharged onto the discharge tray 73 via the discharge path L11 by the discharge rollers 72 and press the sheet S toward the discharge tray 73. Since each of the stack levers 75 has substantially the same configuration as that in the aforementioned first illustrative embodiment, a detailed explanation thereof will be omitted.

2-5. Upper End Cover

As shown in FIGS. 8 to 11, the upper end cover 25 is attached to an upper end portion of the apparatus main body 2. The upper end cover 25 is located above the stack levers 75 and covers the stack levers 75 from above. When attached to the apparatus main body 2, the upper end cover 25 constitutes the upper surface of the image forming apparatus 1.

The upper end cover 25 is detachably attached to the apparatus main body 2. The upper end cover 25 is configured to switch its state between a covering state (see FIG. 11) and an open state (see FIG. 14). In the covering state, the upper end cover 25 is attached to the apparatus main body 2 and covers the upper side of the stack levers 75. In the open state, the upper cover 25 is removed from the apparatus main body 2 to open the upper side of the stack levers 75.

Thus, the upper end cover 25 is switchable between the covering state and the open state. Hence, for instance, when the sheet S to be discharged toward the discharge tray 73 by the two discharge rollers 72 is jammed, by removing the upper end cover 25 from the apparatus main body 2 and switching the upper end cover 25 to the open state, the user is allowed to more efficiently deal with the sheet jam.

The upper end cover 25 has a downstream end portion 25A and an upstream end portion 25B in the sheet discharge direction. The upper end cover 25 attached to the apparatus main body 2 extends up to a position downstream of the stack levers 75 in the sheet discharge direction, above the stack levers 75. In other words, the downstream end portion 25A of the upper end cover 25 is located downstream of the stack levers 75 in the sheet discharge direction.

Thus, the downstream end of the upper end cover 25 is positioned downstream of the stack levers 75 in the sheet discharge direction. Hence, the stack levers 75 are covered by the upper end cover 25 and are less visible to the user. Thereby, it is possible to prevent the user from incorrectly operating the stack levers 75.

The downstream end portion 25A of the upper end cover 25 has an extension 251 that extends down toward the discharge tray 73. Thus, the extension 251 makes the stack levers 75 less visible to the user at the downstream end portion 25A of the upper end cover 25. Thereby, it is possible to further prevent the user from incorrectly operating the stack levers 75.

However, the downstream end portion 25A of the upper end cover 25 may be shaped to extend horizontally without the extension 251. In this case as well, since the downstream end portion 25A is positioned downstream of the stack levers 75 in the sheet discharge direction, the stack levers 75 are covered by the upper end cover 25 and are less visible to the user.

The downstream end portion 25A of the upper end cover 25 is disposed to face the tip portion 75B of each stack lever 75. The downstream end portion 25A of the upper end cover 25 is configured to guide the sheet S being conveyed downstream in the sheet discharge direction along the first path L21, between the downstream end portion 25A and the stack levers 75. The sheet S, which is being guided by the downstream end portion 25A of the upper end cover 25, is guided towards the discharge tray 73 by the extension 251 of the downstream end portion 25A.

Thus, since the sheet S being conveyed along the first path L21 is guided toward the discharge tray 73 by the extended portion 251 of the downstream end portion 25A, the sheet S is not excessively conveyed forward while floating upward from the discharge tray 73. Thereby, it is possible to prevent the user from touching the sheet S which is being conveyed downstream in the sheet discharge direction along the first path L21.

The downstream end portion 25A of the upper end cover 25 has a first recess 252 that is recessed upward from a lower end of the downstream end portion 25A at a middle portion of the downstream end portion 25A in the left-to-right direction. The upstream end portion 25B of the upper end cover 25 has a second recess 253 that is recessed forward at a middle portion, in the left-to-right direction, of a lower end portion of the upstream end portion 25B.

The first recess 252 and the second recess 253 are configured such that the user puts his or her hand(s) thereon when removing the upper end cover 25 attached to the apparatus main body 2. Thus, the user is allowed to easily remove the upper end cover 25 from the apparatus main body 2 with his or her hand(s) put on the first recess 252 and/or the second recess 253.

In particular, the first recess 252 and the second recess 253 are disposed at the downstream end portion 25A and the upstream end portion 25B of the upper end cover 25, respectively. Hence, to remove the upper end cover 25, the user may access the upper end cover 25 from any of the downstream end portion 25A and the upstream end portion 25B. Thus, the user is allowed to more easily remove the upper end cover 25 from the apparatus main body 2.

In the second illustrative embodiment, the upper end cover 25 has the first recess 252 and the second recess 253. However, the upper end cover 25 may be configured without the first recess 252 or the second recess 253. In this case, the user may remove the upper end cover 25 from the apparatus main body 2, for instance, by putting his or her hand on a portion, of the downstream end portion 25A of the upper end cover 25, which is located spaced apart upward from the discharge tray 73.

The rear cover 21 of the apparatus main body 2 has a third recess 21*b* that is recessed forward at a middle portion, in the left-to-right direction, of an upper end portion of the rear cover 21. The third recess 21*b* is configured to be grasped by the user to open or close the rear cover 21. The user is allowed to easily open and close the rear cover 21 by grasping the third recess 21*b* when opening and closing the rear cover 21.

The third recess 21*b* of the rear cover 21 and the second recess 253 of the upper end cover 25 are disposed adjacent to each other in the vertical direction. Namely, the second recess 253 is adjacent to the third recess 21*b* in the vertical direction.

Thus, since the second recess 253 and the third recess 21*b* are adjacent to each other, the two recesses 253 and 21*b* serve as a larger integrated recess when used together. Hence, even though each of the second and third recesses 253 and 21*b* is formed small, the user is allowed to easily grasp them. Thereby, it is possible to reduce a space occupied by the second recess 253 and the third recess 21*b* at the rear end portion of the apparatus main body 2.

Figure 8:
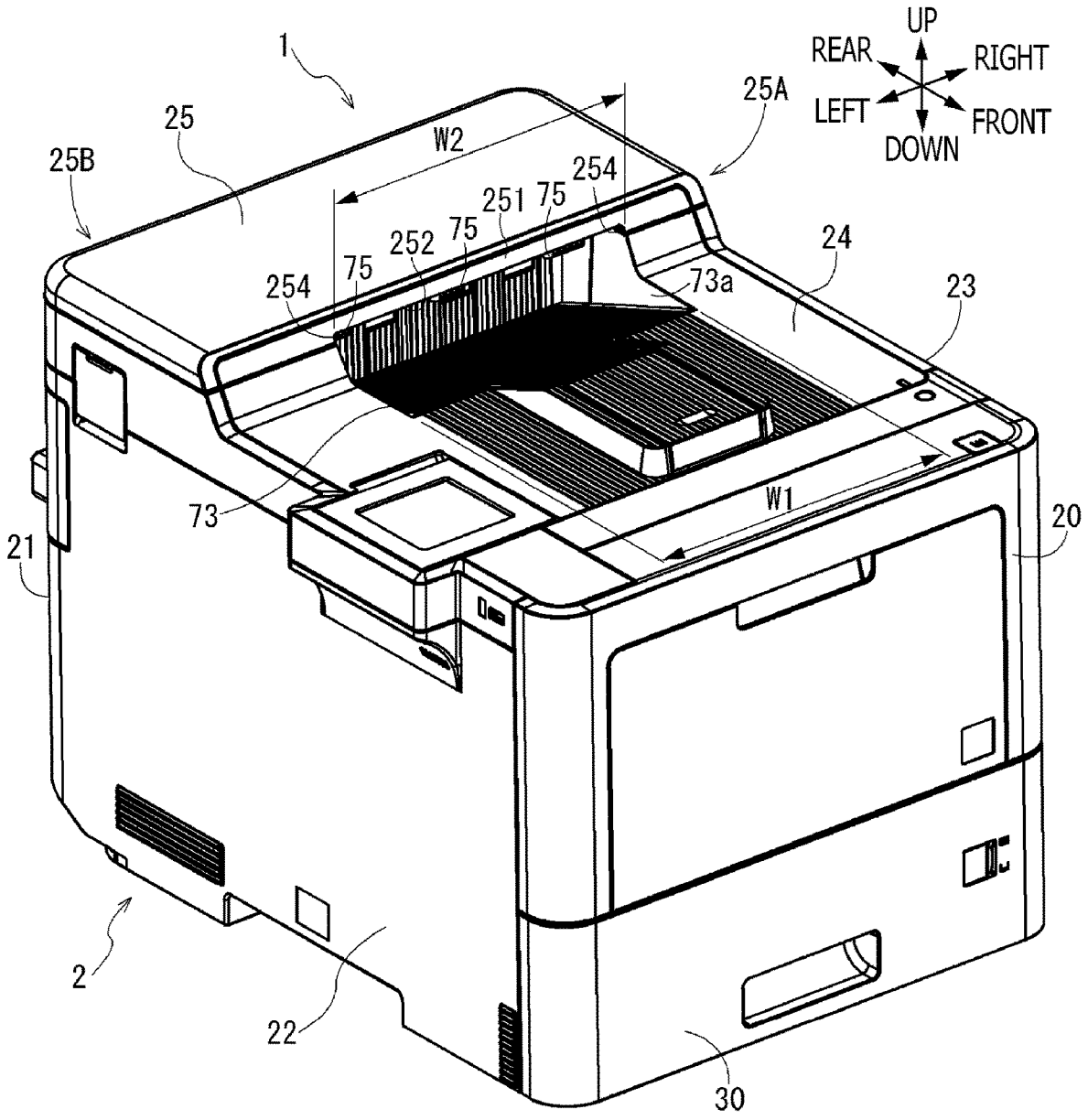
FIG. 8 is a perspective view of the image forming apparatus in the second illustrative embodiment according to one or more aspects of the present disclosure.
Figure 9:
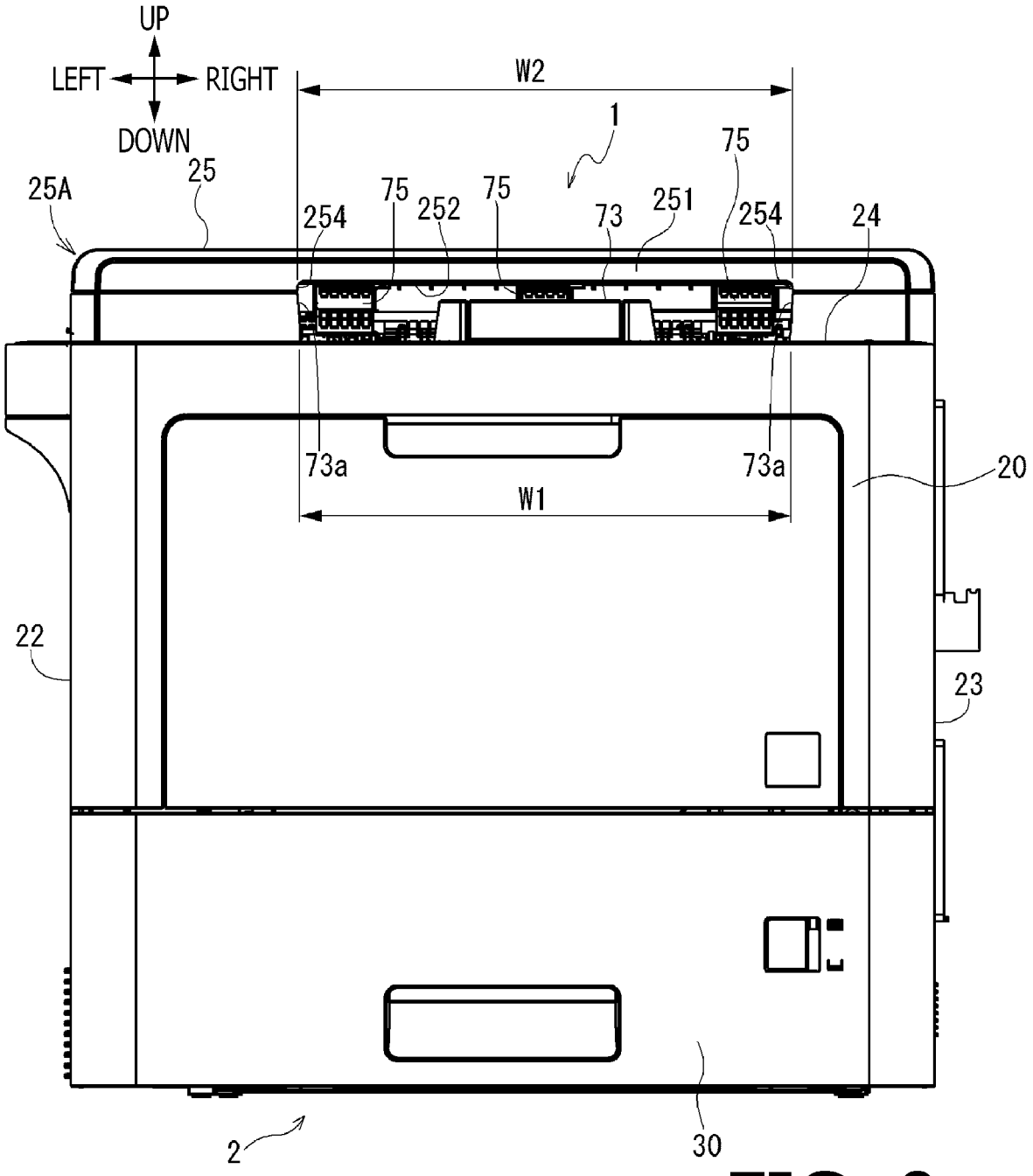
FIG. 9 is a front view of the image forming apparatus in the second illustrative embodiment according to one or more aspects of the present disclosure.
Figure 10:
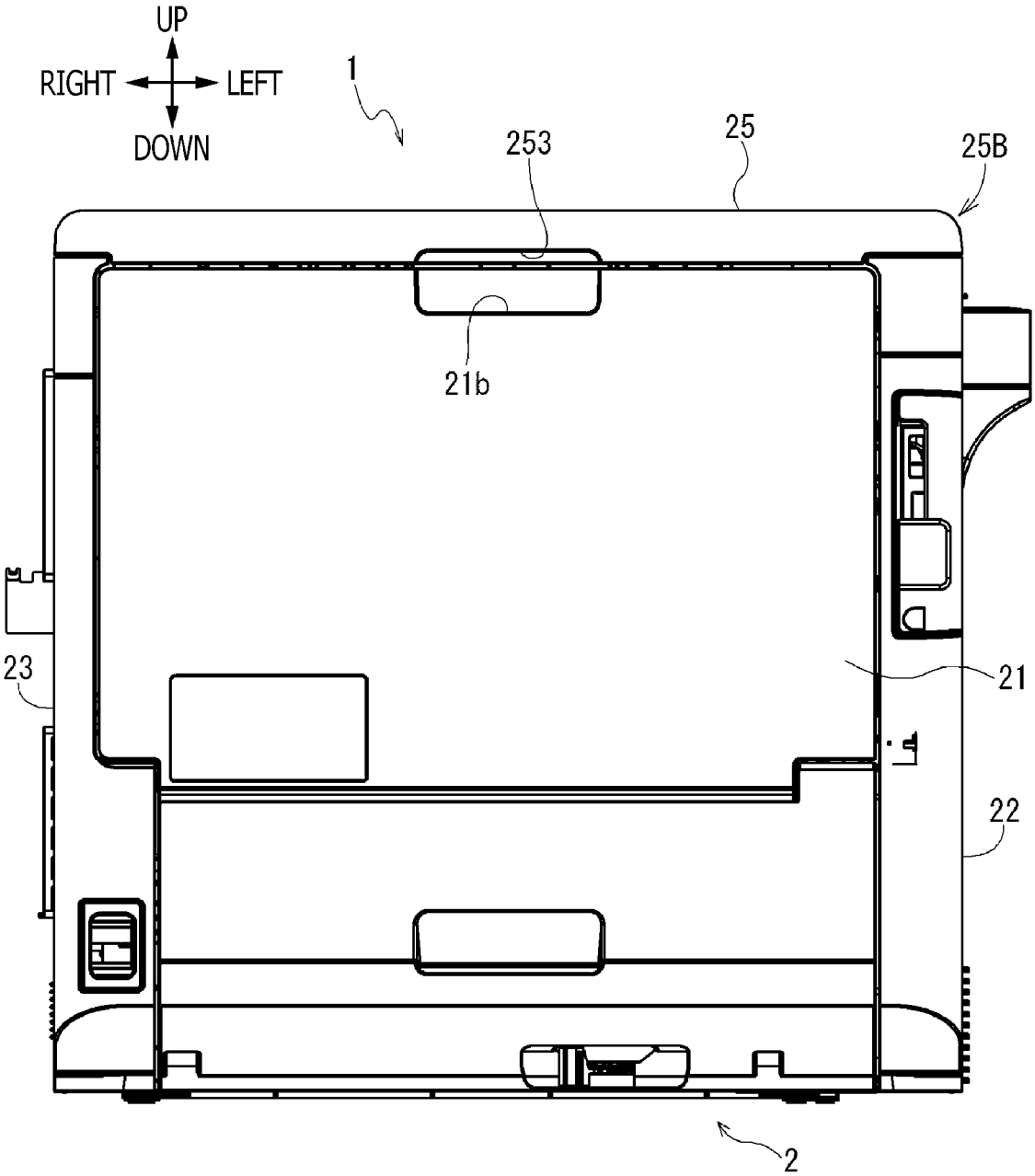
FIG. 10 is a rear view of the image forming apparatus in the second illustrative embodiment according to one or more aspects of the present disclosure.
Figure 11:
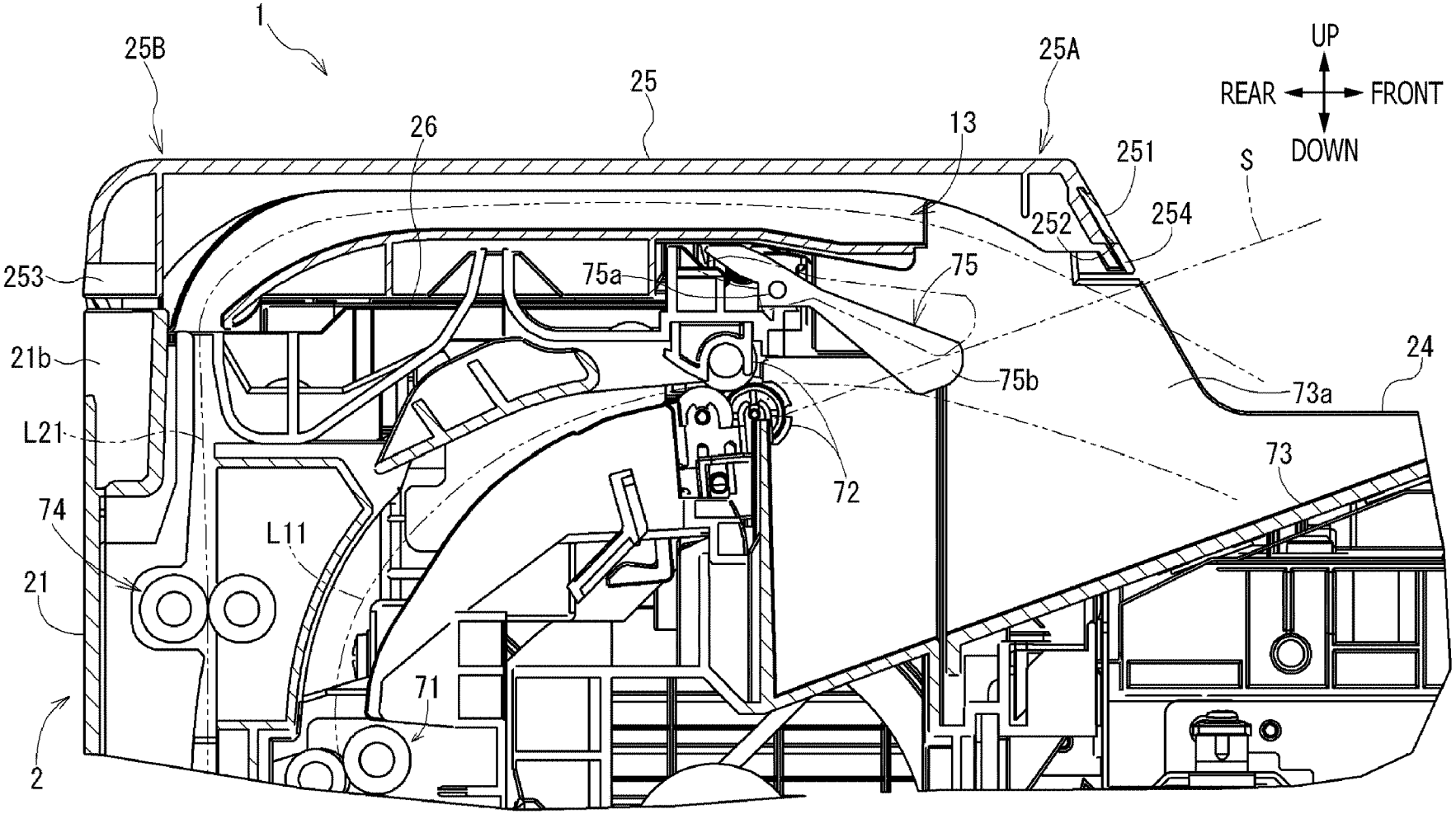
FIG. 11 is a cross-sectional side view showing a configuration around a sheet discharger of the image forming apparatus in the second illustrative embodiment according to one or more aspects of the present disclosure.

As shown in FIGS. 8 and 9, the first recess 252 of the upper end cover 25 has a width W2 identical to a width W1 of the discharge tray 73 in a width direction that is perpendicular to the sheet discharge direction. The first recess 252 has side surfaces 254 that face each other in the width direction, at both ends of the first recess 252 in the left-to-right direction. Further, the discharge tray 73 has side surfaces 73*a* that face each other in the width direction, at both ends of the discharge tray 73 in the left-to-right direction. Each of the side surfaces 73*a* of the discharge tray 73 is disposed flush with a corresponding one of the side surfaces 254 of the first recess 252.

The side surfaces 73*a* of the discharge tray 73 serve as guide surfaces for the sheet S discharged on the discharge tray 73 in the left-to-right direction. Further, since each of the side surfaces 73*a* of the discharge tray 73 is flush with the corresponding one of the side surfaces 254 of the first recess 252, the side surfaces 254 may be used as guide surfaces for the sheets S discharged on the discharge tray 73, in substantially the same manner as the side surfaces 73*a*. In addition, since each of the side surfaces 73*a* of the discharge tray 73 is flush with the corresponding one of the side surfaces 254 of the first recess 252 with no steps formed between the side surfaces 73*a* and the side surfaces 254, it is possible to provide an improved design of the image forming apparatus 1.

However, in the image forming apparatus 1, the width W2 of the first recess 252 may be smaller than the width W1 of the discharge tray 73. Further, each of the side surfaces 73*a* of the discharge tray 73 may not be flush with the corresponding one of the side surfaces 254 of the first recess 252. In this case, for instance, each of the side surfaces 254 of the first recess 252 may be positioned closer to a center of the upper end cover 25 in the left-to-right direction than the corresponding one of the side surfaces 73*a* of the discharge tray 73 is.

Figure 12:
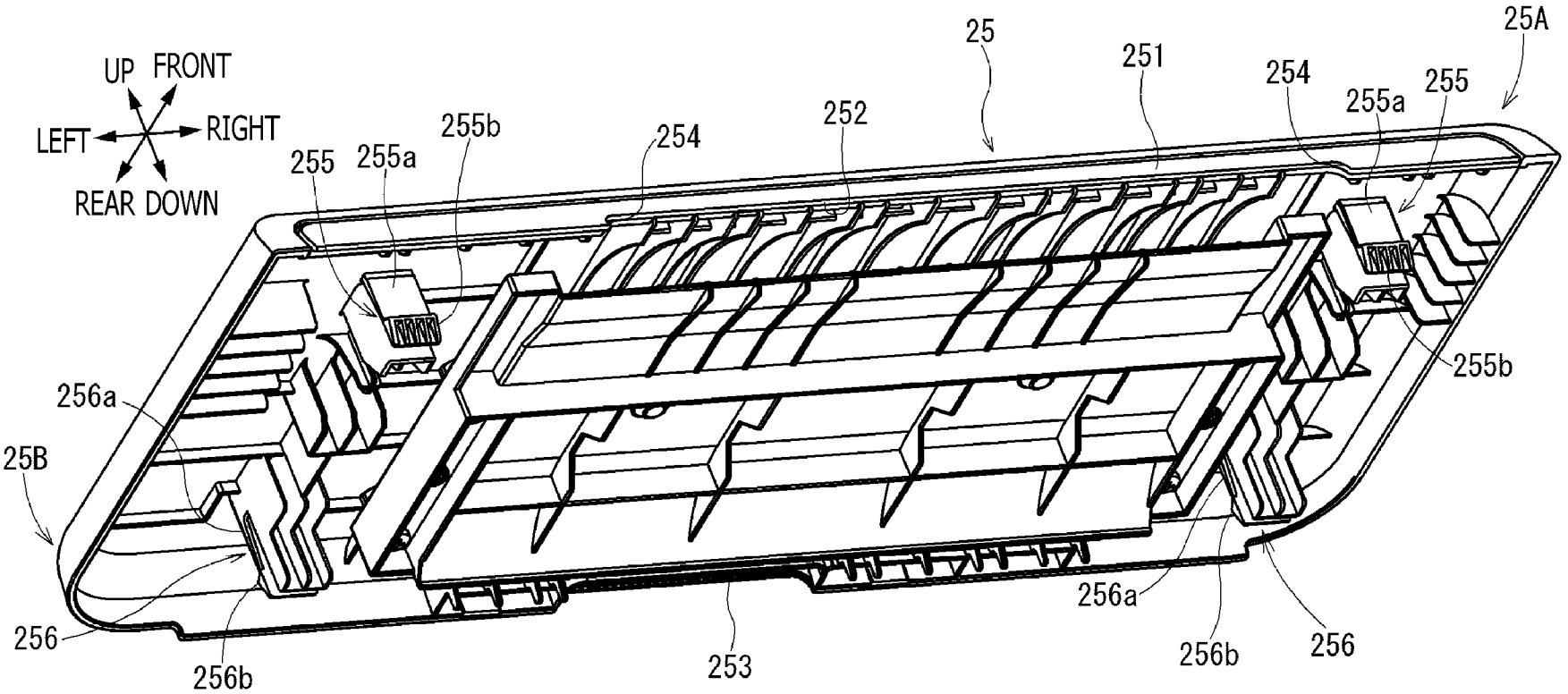
FIG. 12 is a perspective view showing a lower surface side of an upper end cover of the image forming apparatus in the second illustrative embodiment according to one or more aspects of the present disclosure.
Figure 14:
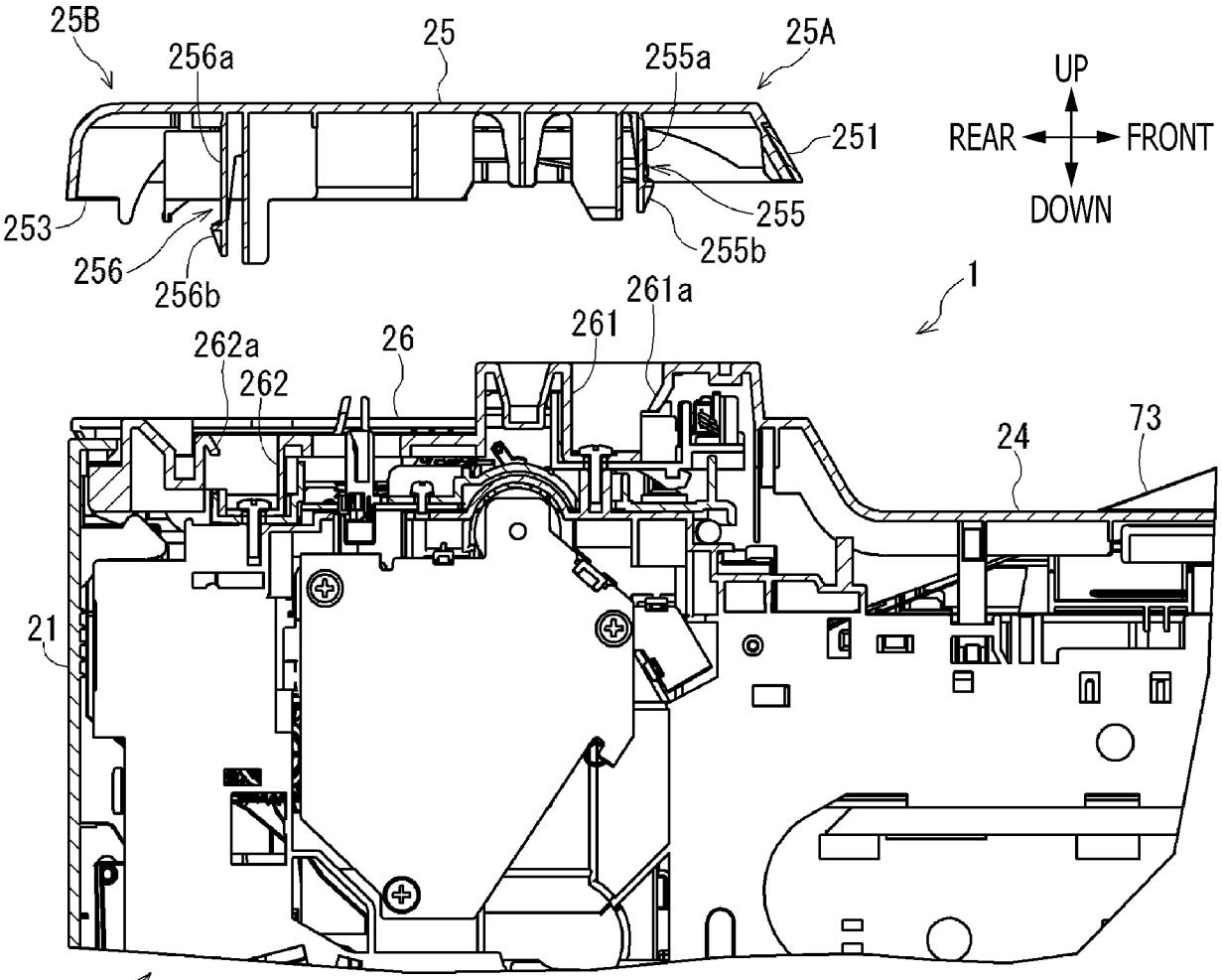
FIG. 14 is a cross-sectional side view showing an attachment portion between the upper end cover and the apparatus main body when the upper end cover is removed from the apparatus main body, in the second illustrative embodiment according to one or more aspects of the present disclosure.

As shown in FIGS. 12 and 14, the upper end cover 25 includes front engagement sections 255 and rear engagement sections 256 that are configured to engage with the apparatus main body 2 when the upper end cover 25 is attached to the apparatus main body 2.

The front engagement sections 255 are disposed at both ends, in the left-to-right direction, of a front end portion of the upper end cover 25. The rear engagement sections 256 are disposed at both ends, in the left-to-right direction, of a rear end portion of the upper end cover 25.

Each front engagement section 255 includes a leg 255*a* and a protrusion 255*b*. The leg 255*a* extends downward from a lower surface of the upper end cover 25. The protrusion 255*b* is disposed at a lower end portion of the leg 255*a* and is formed to protrude forward. Each rear engagement section 256 includes a leg 256*a* and a protrusion 256*b*. The leg 256*a* extends downward from the lower surface of the upper end cover 25. The protrusion 256*b* is disposed at a lower end portion of the leg 256*a* and is formed to protrude rearward. The legs 255*a* of the front engagement sections 255 and the legs 256*a* of the rear engagement sections 256 are elastically deformable.

Figure 13:
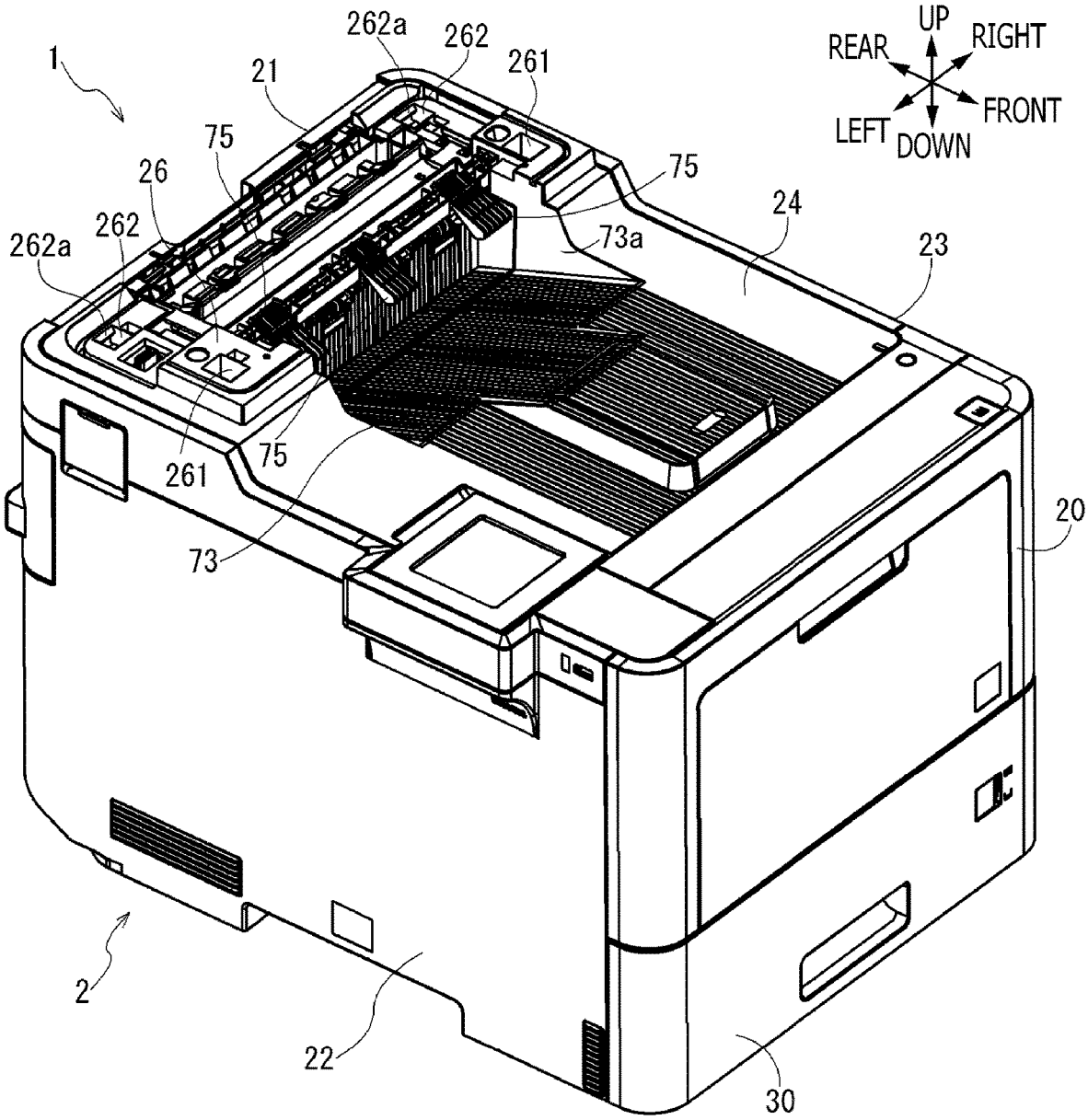
FIG. 13 is a perspective view of the image forming apparatus when the upper end cover is removed from an apparatus main body, in the second illustrative embodiment according to one or more aspects of the present disclosure.

As shown in FIGS. 13 and 14, the apparatus main body 2 has an attachment surface 26 to which the upper end cover 25 is attached. The attachment surface 26 has front engaged sections 261 and rear engaged sections 262. Each of the front engaged sections 261 is configured to be engaged with a corresponding one of the front engagement sections 255 when the upper end cover 25 is attached to the apparatus main body 2. Each of the rear engaged sections 262 is configured to be engaged with a corresponding one of the rear engagement sections 256 when the upper end cover 25 is attached to the apparatus main body 2.

Each front engaged section 261 of the apparatus main body 2 is formed in a concave shape to be concave downward from the attachment surface 26. Each front engaged section 261 includes an engagement pawl 261*a* formed at a front side surface thereof. Each engagement pawl 261*a* is configured to be engaged with a corresponding one of the front engagement sections 255 when the upper end cover 25 is attached to the apparatus main body 2. Each rear engaged section 262 of the apparatus main body 2 is formed in a concave shape to be concave downward from the attachment surface 26. Each rear engaged section 262 includes an engagement pawl 262*a* formed at a rear side surface thereof. Each engagement pawl 262*a* is configured to be engaged with a corresponding one of the rear engagement sections 256 when the upper end cover 25 is attached to the apparatus main body 2.

Figure 15:
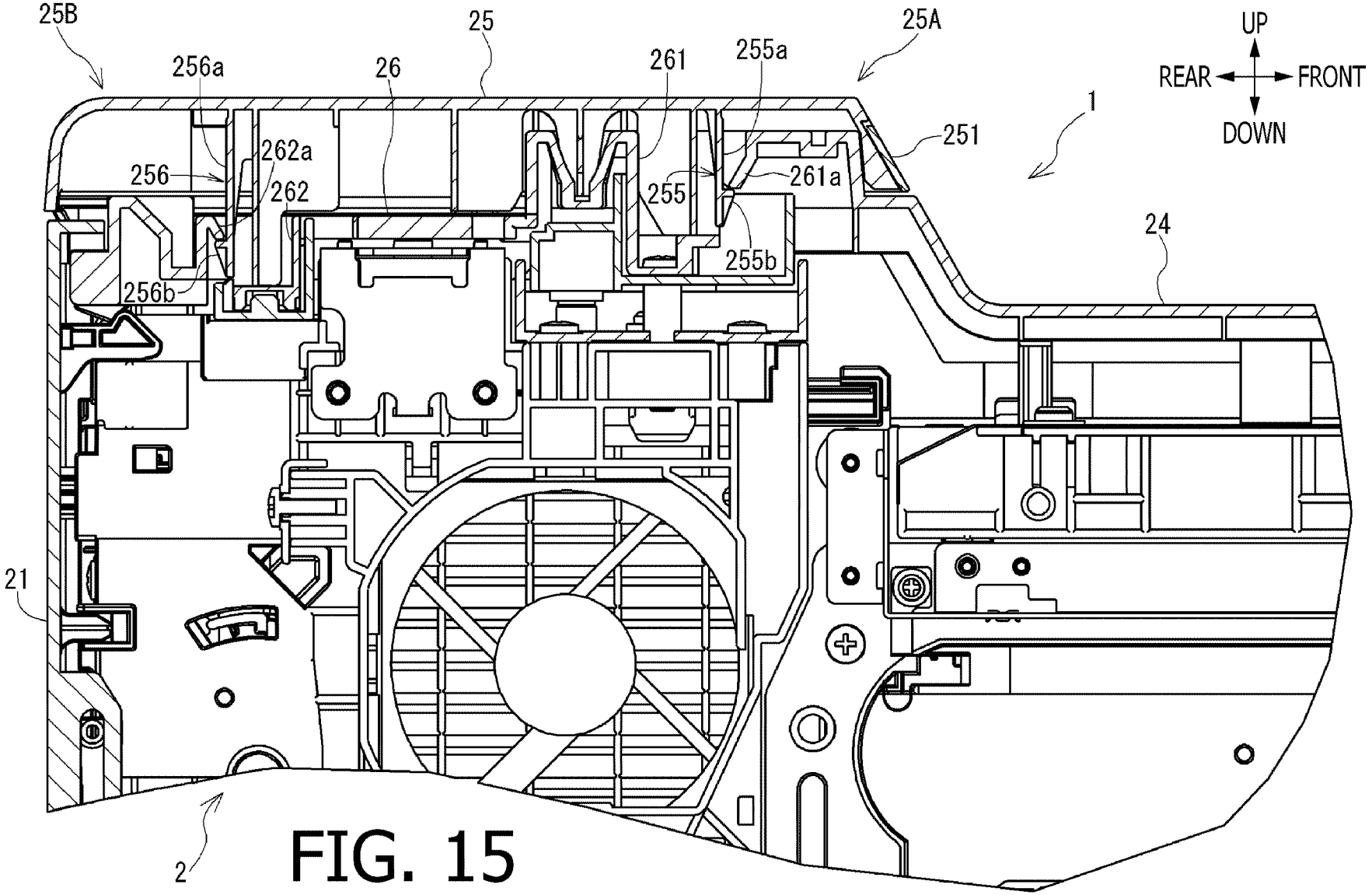
FIG. 15 is a cross-sectional side view showing the attachment portion between the upper end cover and the apparatus main body when the upper end cover is attached to the apparatus main body, in the second illustrative embodiment according to one or more aspects of the present disclosure.

As shown in FIG. 15, the protrusion 255*b* of each front engagement section 255 engages with the engagement pawl 261*a* of the corresponding front engaged section 261 when the upper end cover 25 is attached to the apparatus main body 2. The protrusion 256*b* of each rear engagement section 256 engages with the engagement pawl 262*a* of the corresponding rear engaged section 262 when the upper end cover 25 is attached to the apparatus main body 2.

Thus, when the upper end cover 25 is attached to the apparatus main body 2, the protrusions 255*b* engage with the engagement pawls 261*a*, and the protrusions 256*b* engage with the engagement pawls 262*a*. Thereby, the upper end cover 25 is fixedly mounted on the apparatus main body 2.

In the upper end cover 25, the protrusion 255*b* of each front engagement section 255 protrudes forward, and the protrusion 256*b* of each rear engagement section 256 protrudes rearward. That is, the protrusions 255*b* and 256*b* protrude in respective directions along the front-to-rear direction that is substantially parallel to the sheet discharge direction.

Thus, the protrusions 255*b* and 256*b* configured to engage with the apparatus main body 2 protrude substantially along the sheet discharge direction. Therefore, when the upper end cover 25 attached to the apparatus main body 2 is lifted by grasping the first recess 252 of the downstream end portion 25A or the second recess 253 of the upstream end portion 25B, it is possible to disengage the front engagement sections 255 or the rear engagement sections 256 from the apparatus main body 2, without applying an excessive force to the protrusions 255*b* and 256*b*.

For instance, when the downstream end portion 25A of the upper end cover 25 is lifted by grasping the first recess 252, the leg 255*a* of each front engagement section 255 bends, and the protrusions 255*b* move rearward. Thus, the engagement between the protrusions 255*b* and the engagement pawls 261*a* is released. Further, when the upstream end portion 25B of the upper end cover 25 is lifted by grasping the second recess 253, the leg 256*a* of each rear engagement section 256 bends, and the protrusions 256*b* moves forward. Thus, the engagement between the protrusions 256*b* and the engagement pawls 262*a* is released.

By lifting the upper end cover 25 while grasping the first recess 252 or the second recess 253, it is possible to release the engagement between the protrusions 255*b* and the engagement pawls 261*a* or the engagement between the protrusions 256*b* and the engagement pawls 262*a*, thereby easily removing the upper end cover 25 from the apparatus main body 2.

Hereinabove, the illustrative embodiments according to aspects of the present disclosure have been described. Aspects of the present disclosure may be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that aspects of the present disclosure may be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that aspects of the present disclosure are capable of use in various other combinations and environments and are capable of changes or modifications within the scope of the inventive concept as expressed herein.

The following shows examples of associations between elements exemplified in the aforementioned illustrative embodiments and modifications and elements according to aspects of the present disclosure. The image forming apparatus 1 may be an example of an "image forming apparatus" according to aspects of the present disclosure. The apparatus main body 2 may be an example of an "apparatus main body" according to aspects of the present disclosure. The image forming engine 5 may be an example of an "image forming engine" according to aspects of the present disclosure. The re-conveyance path L2 may be an example of a "re-conveyance path" according to aspects of the present disclosure. The discharge tray 73 may be an example of a "discharge tray" according to aspects of the present disclosure. The discharge path L11 may be an example of a "discharge path" according to aspects of the present disclosure. The two discharge rollers 72 may be included in examples of a "discharge roller" according to aspects of the present disclosure. The stack levers 75 may be included in examples of a "stack lever" according to aspects of the present disclosure. The guide member 25 may be an example of a "guide member" according to aspects of the present disclosure. The upper end cover 25 may be an example of a "cover" according to aspects of the present disclosure. The path L21*b* of the first path L21 of the re-conveyance path L2 may be an example of a "guide" of the "cover" according to aspects of the present disclosure. The first guide surface 25*b* may be an example of a "first guide surface" according to aspects of the present disclosure. The lower path surface 25*c* may be an example of a "second guide surface" according to aspects of the present disclosure. The extension 252 may be an example of an "extension" according to aspects of the present disclosure. The first recess 252 may be an example of a "first recess" according to aspects of the present disclosure. The second recess 253 may be an example of a "second recess" according to aspects of the present disclosure. The upstream end portion 25B of the upper end cover 25 may be an example of an "upstream end portion" of the "cover" according to aspects of the present disclosure. The side surfaces 73*a* of the discharge tray 73 may be an example of "side surfaces" of the discharge tray" according to aspects of the present disclosure. The side surfaces 254 of the first recess 252 may be an example of "side surfaces" of the "first recess" according to aspects of the present disclosure. The rear cover 21 may be an example of an "upstream end cover" according to aspects of the present disclosure. The third recess 21*b* of the rear cover 21 may be an example of a "third recess" of the "upstream end cover" according to aspects of the present disclosure. The front engagement sections 255 and the rear engagement sections 256 of the upper end cover 25 may be included in examples of an "engagement section" of the "cover" according to aspects of the present disclosure. The protrusion 255*b* of each front engagement section 255 and the protrusion 256*b* of each rear engagement section 256 may be included in examples of a "protrusion" of the "engagement section" according to aspects of the present disclosure.

What is claimed is:

1. An image forming apparatus comprising:

an image forming engine configured to form an image on a sheet;

a re-conveyance path configured to guide the sheet, on which the image is formed by the image forming engine, to be switched back and re-conveyed toward the image forming engine;

a discharge tray;

a discharge path configured to guide the sheet in a sheet discharge direction toward the discharge tray;

a stack lever configured to contact a top surface of the sheet on the discharge tray and press the sheet toward the discharge tray;

a guide member configured to form a part of the re-conveyance path, extend up to a position downstream of the stack lever in the sheet discharge direction above the stack lever, and guide the sheet being conveyed along the re-conveyance path, between the guide member and the stack lever;

wherein a downstream end portion of the guide member in the sheet discharge direction has a first guide surface configured to guide the sheet being conveyed along the re-conveyance path toward the discharge tray; and wherein the first guide surface is formed in a curved shape to approach the discharge tray as going downstream in the sheet discharge direction.

2. The image forming apparatus according to claim 1, wherein the first guide surface is opposed to a downstream end portion of the stack lever in the sheet discharge direction.

3. The image forming apparatus according to claim 1, wherein the stack lever is movable between:

a first position where the stack lever is restricted from moving any further toward the first guide surface; and a second position where the stack lever is farther from the first guide surface than when the stack lever is in the first position, and wherein an upper end of the stack lever in the first position is as high as or lower than a lower end of the first guide surface.

4. The image forming apparatus according to claim 1, wherein the guide member has a second guide surface configured to form a lower surface of a downstream end portion of the re-conveyance path in the sheet discharge direction, and wherein a lower end of the first guide surface is lower than a downstream end of the second guide surface in the sheet discharge direction.

5. The image forming apparatus according to claim 1, wherein the guide member is switchable between:

a covering state to cover an upper side of the stack lever; and an open state to open the upper side of the stack lever.

6. The image forming apparatus according to claim 1, wherein the downstream end portion of the guide member has an extension that extends down toward the discharge tray.

7. The image forming apparatus according to claim 1, wherein the guide member includes:

a first recess formed at the downstream end portion of the guide member in the sheet discharge direction; and a second recess formed at an upstream end portion of the guide member in the sheet discharge direction.

8. The image forming apparatus according to claim 7, wherein the discharge tray has side surfaces that face each other in a width direction perpendicular to the sheet discharge direction, wherein the first recess has side surfaces that face each other in the width direction, and wherein each of the side surfaces of the discharge tray is disposed flush with a corresponding one of the side surfaces of the first recess.

9. The image forming apparatus according to claim 7, further comprising an upstream end cover that is rotatably provided at an upstream end portion of the apparatus main body in the sheet discharge direction, wherein the upstream end cover has a third recess configured to be grasped when the upstream end cover is opened or closed relative to the apparatus main body, and wherein the third recess of the upstream end cover is adjacent to the second recess of the cover.

10. The image forming apparatus according to claim 7, wherein the guide member includes an engagement section configured to engage with the apparatus main body when the cover is attached to the apparatus main body, and wherein the engagement section includes a protrusion formed to protrude along the sheet discharge direction.

11. An image forming apparatus comprising:

an apparatus main body;

an image forming engine configured to form an image on a sheet;

a re-conveyance path configured to guide the sheet, on which the image is formed by the image forming engine, to be switched back and re-conveyed toward the image forming engine;

a discharge roller configured to discharge the sheet in a sheet discharge direction from the apparatus main body;

a discharge tray configured to support the sheet discharged by the discharge roller;

a stack lever configured to contact a top surface of the sheet discharged on the discharge tray and press the sheet toward the discharge tray;

a cover removably attachable to the apparatus main body, the cover being configured to, when attached to the apparatus main body, form at least a part of an upper surface of the image forming apparatus and cover the stack lever from above, the cover including a guide configured to, when the cover is attached to the apparatus main body, serve as a part of the re-conveyance path, extend up to a position downstream of the stack lever in the sheet discharge direction above the stack lever, and guide the sheet being conveyed along the re-conveyance path, between the cover and the stack lever;

wherein a downstream end portion of the guide in the sheet discharge direction has a first guide surface configured to guide the sheet being conveyed along the re-conveyance path toward the discharge tray; and wherein the first guide surface is formed in a curved shape to approach the discharge tray as going downstream in the sheet discharge direction.

12. The image forming apparatus according to claim 11, wherein the downstream end portion of the guide has an extension that extends down toward the discharge tray.

13. The image forming apparatus according to claim 11, wherein the guide includes:

a first recess formed at the downstream end portion of the guide in the sheet discharge direction; and a second recess formed at an upstream end portion of the guide in the sheet discharge direction.

14. The image forming apparatus according to claim 13, wherein the discharge tray has side surfaces that face each other in a width direction perpendicular to the sheet discharge direction, wherein the first recess has side surfaces that face each other in the width direction, and wherein each of the side surfaces of the discharge tray is disposed flush with a corresponding one of the side surfaces of the first recess.

15. The image forming apparatus according to claim 13, further comprising an upstream end cover that is rotatably provided at an upstream end portion of the apparatus main body in the sheet discharge direction, wherein the upstream end cover has a third recess configured to be grasped when the upstream end cover is opened or closed relative to the apparatus main body, and wherein the third recess of the upstream end cover is adjacent to the second recess of the cover.

16. The image forming apparatus according to claim 13, wherein the guide includes an engagement section configured to engage with the apparatus main body when the cover is attached to the apparatus main body, and wherein the engagement section includes a protrusion formed to protrude along the sheet discharge direction.

17. The image forming apparatus according to claim 11, wherein the first guide surface is opposed to a downstream end portion of the stack lever in the sheet discharge direction.

18. The image forming apparatus according to claim 11, wherein the stack lever is movable between:

a first position where the stack lever is restricted from moving any further toward the first guide surface; and a second position where the stack lever is farther from the first guide surface than when the stack lever is in the first position, and wherein an upper end of the stack lever in the first position is as high as or lower than a lower end of the first guide surface.

19. The image forming apparatus according to claim 11, wherein the guide has a second guide surface configured to form a lower surface of a downstream end portion of the re-conveyance path in the sheet discharge direction, and wherein a lower end of the first guide surface is lower than a downstream end of the second guide surface in the sheet discharge direction.

20. The image forming apparatus according to claim 11, wherein the guide is switchable between:

a covering state to cover an upper side of the stack lever; and an open state to open the upper side of the stack lever.

* * * * *